US011114049B2

(12) United States Patent
Hirotsune et al.

(10) Patent No.: US 11,114,049 B2
(45) Date of Patent: Sep. 7, 2021

(54) LIQUID CRYSTAL DISPLAY DEVICE

(71) Applicants: Panasonic Liquid Crystal Display Co., Ltd., Himeji (JP); Pasona Knowledge Partner Inc., Osaka (JP)

(72) Inventors: Satoshi Hirotsune, Hyogo (JP); Yasuyuki Suga, Osaka (JP); Tatsuo Itoman, Osaka (JP)

(73) Assignees: PANASONIC LIQUID CRYSTAL DISPLAY CO., LTD., Hyogo (JP); PASONA KNOWLEDGE PARTNER INC., Osaka (JP)

( * ) Notice: Subject to any disclaimer, the term of this patent is extended or adjusted under 35 U.S.C. 154(b) by 11 days.

(21) Appl. No.: 16/691,274

(22) Filed: Nov. 21, 2019

(65) Prior Publication Data

US 2020/0175934 A1 Jun. 4, 2020

(30) Foreign Application Priority Data

Nov. 29, 2018 (JP) ..... JP2018-224266

(51) Int. Cl.
*G09G 3/36* (2006.01)
*G09G 5/06* (2006.01)

(52) U.S. Cl.
CPC ..... *G09G 3/3607* (2013.01); *G09G 5/06* (2013.01); *G09G 2300/023* (2013.01); *G09G 2310/08* (2013.01); *G09G 2320/0233* (2013.01); *G09G 2320/0276* (2013.01); *G09G 2320/0285* (2013.01)

(58) Field of Classification Search
CPC ..... G09G 2320/0233; G09G 2310/08; G09G 2320/0276; G09G 2320/0285; G09G 2300/023; G09G 3/3607; G09G 5/06
See application file for complete search history.

(56) References Cited

U.S. PATENT DOCUMENTS 8,482,499 B2 * 7/2013 Kimura ..... G09G 3/3611 345/87
2009/0147186 A1 6/2009 Nakai et al.
2015/0356914 A1 * 12/2015 Aoyama ..... G09G 3/3208 345/690

FOREIGN PATENT DOCUMENTS

JP 2008-122536 5/2008
JP 2008-145981 6/2008
JP 2011-076107 4/2011
(Continued)

*Primary Examiner* — Kent W Chang
*Assistant Examiner* — Scott Au
(74) *Attorney, Agent, or Firm* — Hamre, Schumann, Mueller & Larson, P.C.

(57) ABSTRACT

A liquid crystal display device includes: a display unit including a first liquid crystal panel and a second liquid crystal panel disposed on a rear surface side of the first liquid crystal panel; and an image processor that generates first and second output image signals respectively output to the first and second liquid crystal panels based on an input image signal. The image processor includes; a distributor that distributes the input image signal into first and second distribution image signals used to generate the first and second output image signals, respectively; and a first unevenness corrector that generates the first output image signal by performing first unevenness correction to prevent display unevenness of the display unit on the first distribution image signal output from the distributor, and outputs the generated first output image signal to the first liquid crystal panel.

14 Claims, 20 Drawing Sheets

(56) References Cited

FOREIGN PATENT DOCUMENTS

| | | |
|---|---|---|
| JP | 2015-152707 | 8/2015 |
| WO | 2007/040127 | 4/2007 |

* cited by examiner

LIQUID CRYSTAL DISPLAY DEVICE

CROSS-REFERENCE TO RELATED APPLICATION

This application claims priority from Japanese application JP 2018-224266, filed on Nov. 29, 2018. This Japanese application is incorporated herein by reference.

TECHNICAL FIELD

The present invention relates to a liquid crystal display device.

BACKGROUND

A liquid crystal display device is used as a display of a television, a monitor or the like. However, the liquid crystal display device has a contrast ratio lower than an organic electro luminescence (EL) display device.

A technique, in which two display panels overlap each other and an image is displayed on each display panel, is conventionally proposed as a technique of improving a contrast ratio of a liquid crystal display device (for example, see Unexamined Japanese Patent Publication No. 2011-076107). A color image is displayed on a front-side (observer-side) display panel in two display panels disposed back and forth, and a black-and-white image is displayed on a rear-side (backlight-side) display panel, thereby improving the contrast ratio.

SUMMARY

However, when a plurality of liquid crystal panels are superimposed, a parallax is generated to degrade image quality. In order to prevent the degradation of the image quality due to the parallax, it is conceivable to make an interval of the plurality of liquid crystal panels small. However, when the interval of the plurality of liquid crystal panels is simply made small (for example, when a thickness of an adhesive layer for bonding the plurality of liquid crystal panels is reduced), a cell gap of the liquid crystal panel becomes uneven due to stress between the plurality of liquid crystal panels, and display unevenness is generated.

The present disclosure provides a liquid crystal display device capable of preventing the degradation of the image quality due to the display unevenness.

A liquid crystal display device according to a first disclosure includes: a display unit including a first liquid crystal panel and a second liquid crystal panel that is disposed while superimposed on the first liquid crystal panel on a rear surface side of the first liquid crystal panel; and an image processor that generates a first output image signal output to the first liquid crystal panel and a second output image signal output to the second liquid crystal panel based on an input image signal. The image processor includes: a distributor that distributes the input image signal into a first distribution image signal used to generate the first output image signal and a second distribution image signal used to generate the second output image signal; and a first unevenness corrector that generates the first output image signal by performing first unevenness correction to prevent display unevenness of the display unit on the first distribution image signal output from the distributor, and outputs the generated first output image signal to the first liquid crystal panel.

A liquid crystal display device according to a second disclosure includes: a display unit including a first liquid crystal panel and a second liquid crystal panel that is disposed while superimposed on the first liquid crystal panel on a rear surface side of the first liquid crystal panel; and an image processor that generates a first output image signal output to the first liquid crystal panel and a second output image signal output to the second liquid crystal panel based on an input image signal. The image processor includes: a distributor that distributes the input image signal into the first output image signal and a distribution image signal used to generate the second output image signal; and an unevenness corrector that generates the second output image signal by performing unevenness correction to prevent display unevenness of the display unit on the distribution image signal output from the distributor, and outputs the generated second output image signal to the second liquid crystal panel.

DETAILED DESCRIPTION (Knowledge Forming Basis of the Present Disclosure)

Figure 18:
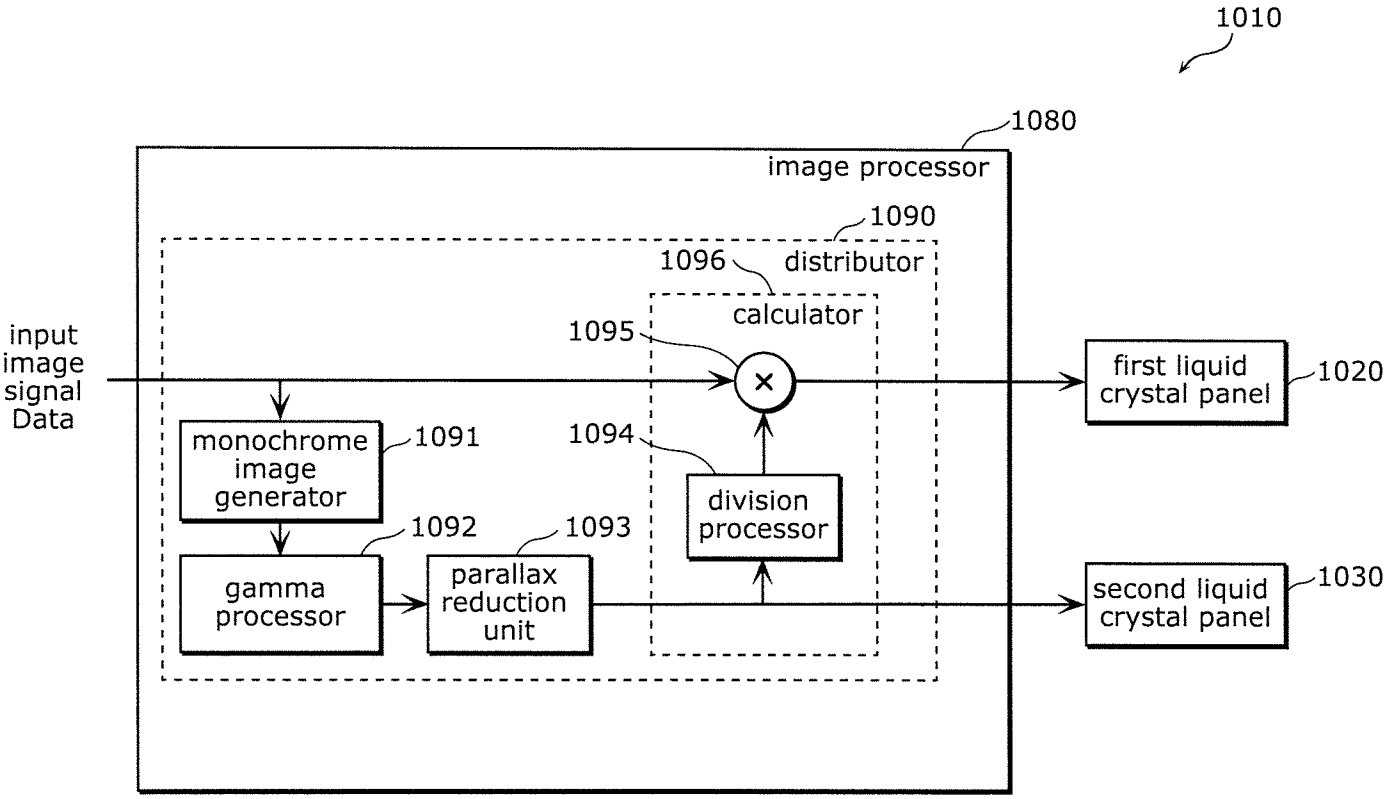
FIG. 18 is a block diagram illustrating a functional configuration of a liquid crystal display device according to a comparative example.

When a plurality of liquid crystal panels (for example, a first liquid crystal panel and a second liquid crystal panel) are superimposed on each other, a parallax is generated according to a distance between the first liquid crystal panel and the second liquid crystal panel, and image quality is degraded. For this reason, it is considered that image processing is performed in order to reduce the parallax. Such a liquid crystal display device will be described with reference to FIG. 18. FIG. 18 is a block diagram illustrating a functional configuration of liquid crystal display device 1010 according to a comparative example.

As illustrated in FIG. 18, liquid crystal display device 1010 includes first liquid crystal panel 1020, second liquid crystal panel 1030, and image processor 1080. Image processor 1080 also includes distributor 1090 that distributes an input image signal to a first output image signal output to first liquid crystal panel 1020 and a second output image signal output to second liquid crystal panel 1030. As used herein, the distribution means generation of the first output image signal and the second output image signal in order to display an image based on the input image signal.

Distributor 1090 includes black-and-white image generator 1091, gamma processor 1092, parallax reduction unit 1093, division processor 1094, and multiplier 1095. Division processor 1094 and multiplier 1095 constitute calculator 1096. First liquid crystal panel 1020 is disposed on an observer side, and displays, for example, a color image. Second liquid crystal panel 1030 is disposed at a position farther from an observer than first liquid crystal panel 1020 is, and displays, for example, a monochrome image.

When acquiring an input image signal, black-and-white image generator 1091 generates black-and-white image data corresponding to a black-and-white image (monochrome image) using a maximum value (an R value, a G value, or a B value) in each color value (for example, an RGB value of [R value, G value, B value]) indicating color information about the input image signal. Specifically, in the RGB value corresponding to each pixel, black-and-white image generator 1091 generates the black-and-white image data by setting the maximum value in the RGB value to the value of the pixel. Black-and-white image generator 1091 outputs the generated black-and-white image data to gamma processor 1092.

Figure 19A:
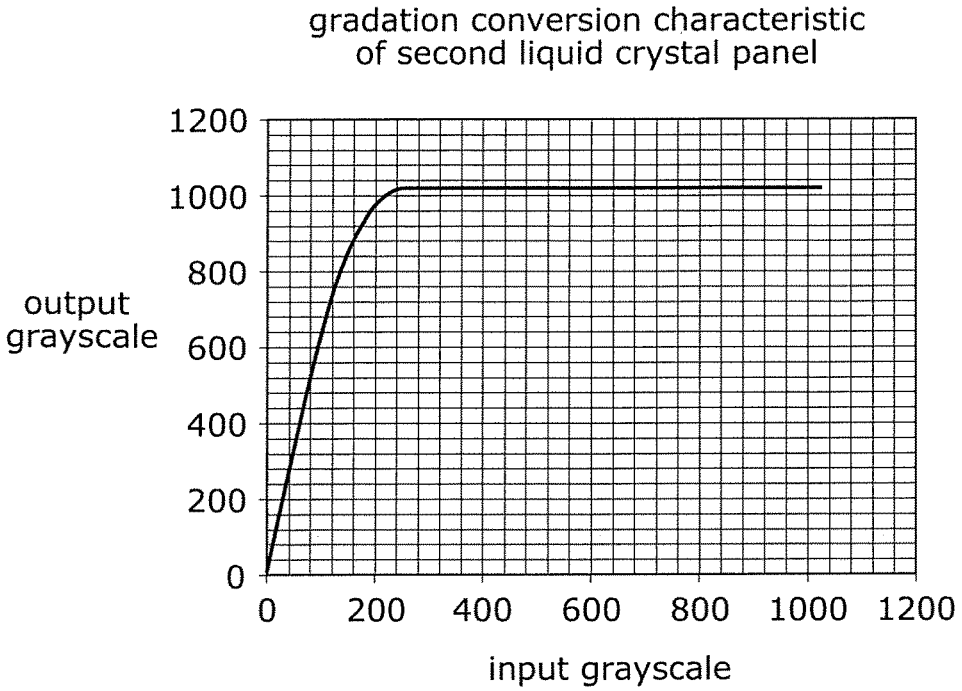
FIG. 19A is a view illustrating a gamma characteristic of a second liquid crystal panel of the comparative example.

Gamma processor 1092 is a processor that converts a gradation value of each pixel in the input image signal according to a gradation conversion characteristic (gamma characteristic) of second liquid crystal panel 1030, and outputs the converted value to parallax reduction unit 1093. As illustrated in FIG. 19A, gamma processor 1092 corrects the gradation value of each pixel greater than or equal to a first gradation value among a plurality of gradation values included in the input image signal to a second gradation value. FIG. 19A is a view illustrating the gamma characteristic of the second liquid crystal panel 1030 of the comparative example. In FIG. 19A, the gradation value (input gradation) corresponding to the black-and-white image data and a gradation value (output gradation) corresponding to post-gamma correction are correlated with each other. For example, when the input gradation is greater than or equal to 256 gradations (an example of the first gradation value), gamma processor 1092 decides 1023 gradations (an example of the second gradation value) that is the maximum value of the output gradation as the output gradation. Gamma processor 1092 includes a conversion table (lookup table) based on the gradation conversion characteristic in FIG. 19A, and decides the gradation value corresponding to the black-and-white image data output to parallax reduction unit 1093 using the conversion table. The first gradation value is not limited to 256 gradations, but is appropriately decided according to an interval between the first liquid crystal panel and the second liquid crystal panel.

Figure 19B:
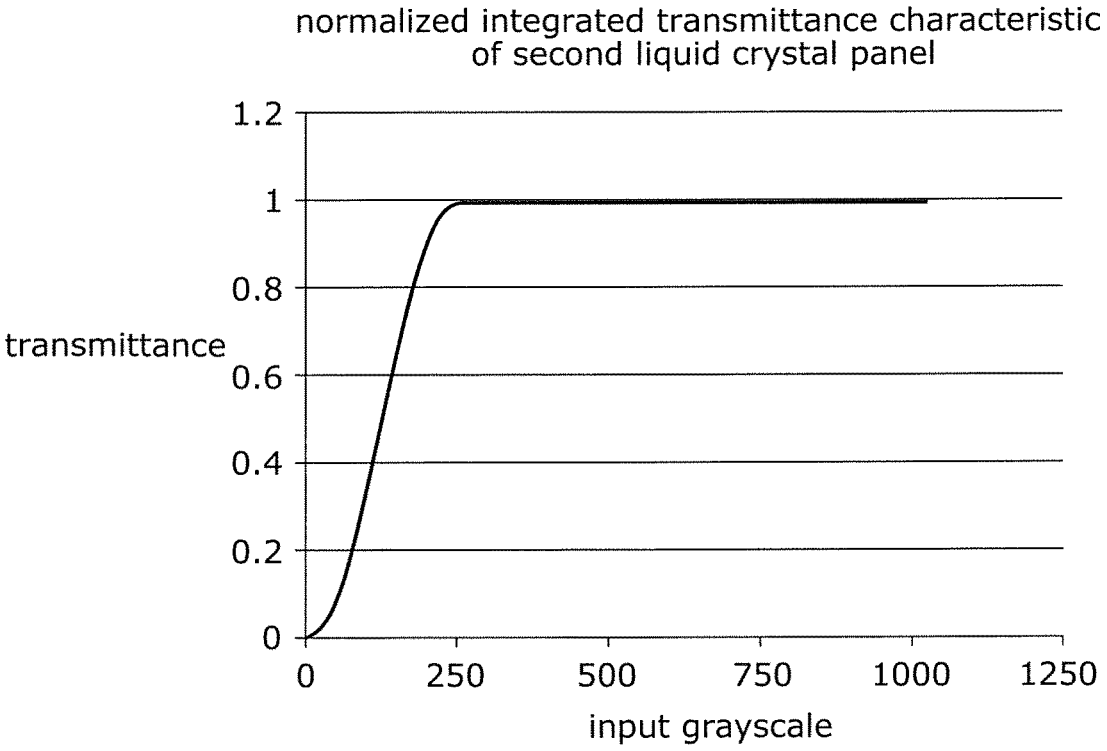
FIG. 19B is a view illustrating a relationship between an input gradation and transmittance of the second liquid crystal panel of the comparative example.

FIG. 19B is a view illustrating a relationship between the input gradation of the comparative example and transmittance of second liquid crystal panel 1030 (in the example of FIG. 19B, normalized integrated transmittance). As illustrated in FIG. 19B, when the input gradation is greater than or equal to 256 gradations, the transmittance of second liquid crystal panel 1030 becomes the maximum value.

Referring to FIG. 18, parallax reduction unit 1093 is a processor that corrects the gradation-corrected input image signal (specifically, the gradation-corrected black-and-white image data) output from gamma processor 1092 in order to reduce the parallax between the first image based on the first output image signal and the second image based on the second output image signal. When acquiring the gradation-converted black-and-white image data, parallax reduction unit 1093 performs an expansion filtering processing of expanding a high-luminance region on the black-and-white image data. For example, the expansion filtering processing is processing of setting the maximum value of luminance within a predetermined filter size (for example, several pixels x several pixels) to the pixel (target pixel) with respect to each pixel (target pixel) of second liquid crystal panel 1030. The expansion filtering processing is performed on each of the plurality of pixels. The high-luminance region (for example, a white region) extends as a whole through the expansion filtering processing. Consequently, the degradation of the image quality due to the generation of the parallax such as a double image in which an outline of the image appears double can be prevented when liquid crystal display device 1010 is viewed from an oblique direction. The filter size is not particularly limited. The filter shape is not limited to the square shape, but may be a circular shape.

For example, parallax reduction unit 1093 is constructed with a so-called MAX filter (maximum value filter). Preferably, the MAX filter may change the filter size. Parallax reduction unit 1093 can perform parallax reduction according to the interval between first liquid crystal panel 1020 and second liquid crystal panel 1030 by deciding an appropriate filter size according to the interval.

The black-and-white image data subjected to the expansion filtering processing is output to second liquid crystal panel 1030 as the second output image signal. The second output image signal is output to calculator 1096 (specifically, division processor 1094).

Calculator 1096 generates the first output image signal for a color image displayed on first liquid crystal panel 1020 based on the input image signal and the second output image signal acquired from parallax reduction unit 1093. Calculator 1096 decides the gradation value of each pixel of the first output image signal such that a composite image of the first image displayed by first liquid crystal panel 1020 based on the first output image signal and the second image displayed by second liquid crystal panel 1030 based on the second output image signal becomes the image based on the input image signal.

Figure 20A:
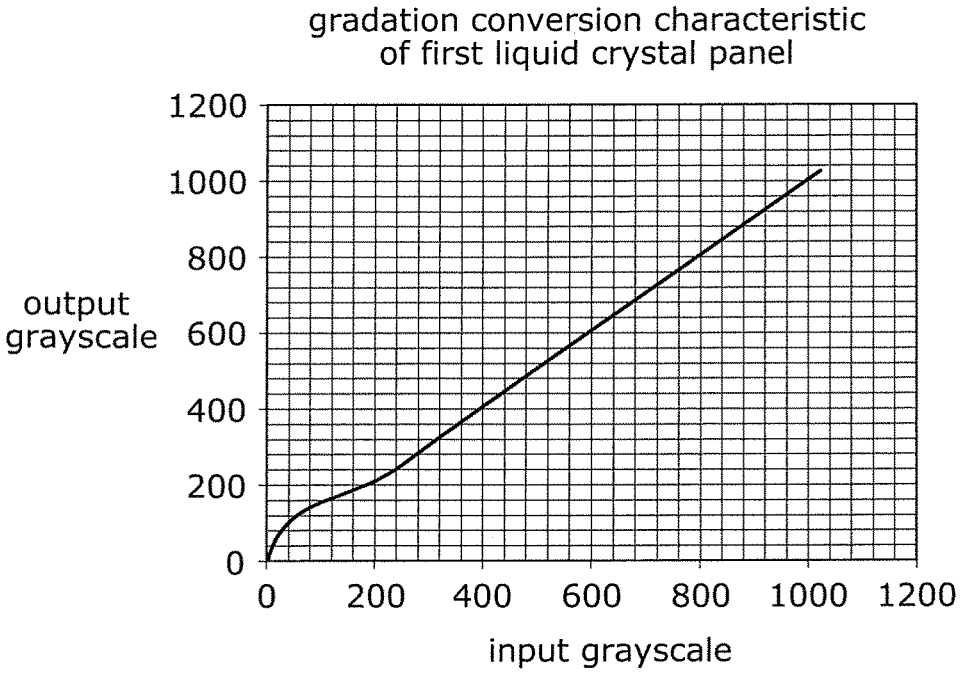
FIG. 20A is a view illustrating the gamma characteristic of the first liquid crystal panel of the comparative example.

Specifically, when receiving the second output image signal (for example, the gradation value of the black-and-white image), division processor 1094 of calculator 1096 acquires an output gradation corresponding to the second output image signal using the gradation conversion characteristic in FIG. 20A. FIG. 20A is a view illustrating the gradation conversion characteristic (gamma characteristic) of first liquid crystal panel 1020 of the comparative example. The input gradation in FIG. 20A means the gradation value of the input image signal corresponding to the gradation value of the second output image signal.

Next, division processor 1094 refers to the correction table (lookup table) to correct the output gradation calculated above, and acquires a correction value for generating the first output image signal. In the correction table, the output gradation and the correction value are correlated with each other. The correction value of the correction table is set according to a reciprocal of the input value of division processor 1094 in the high-gradation range (for example, greater than or equal to 256 gradations). Division processor 1094 outputs the acquired correction value to multiplier 1095.

Multiplier 1095 decides the gradation value of the first output image signal based on the acquired correction value. Specifically, multiplier 1095 decides a value obtained by multiplying the gradation value of the input image signal by the correction value as the gradation value of the first output image signal. Multiplier 1095 outputs the generated first output image data to first liquid crystal panel 1020. Consequently, brightness (for example, the transmittance) of each pixel of first liquid crystal panel 1020 becomes brightness reflecting the expansion filtering processing.

Figure 20B:
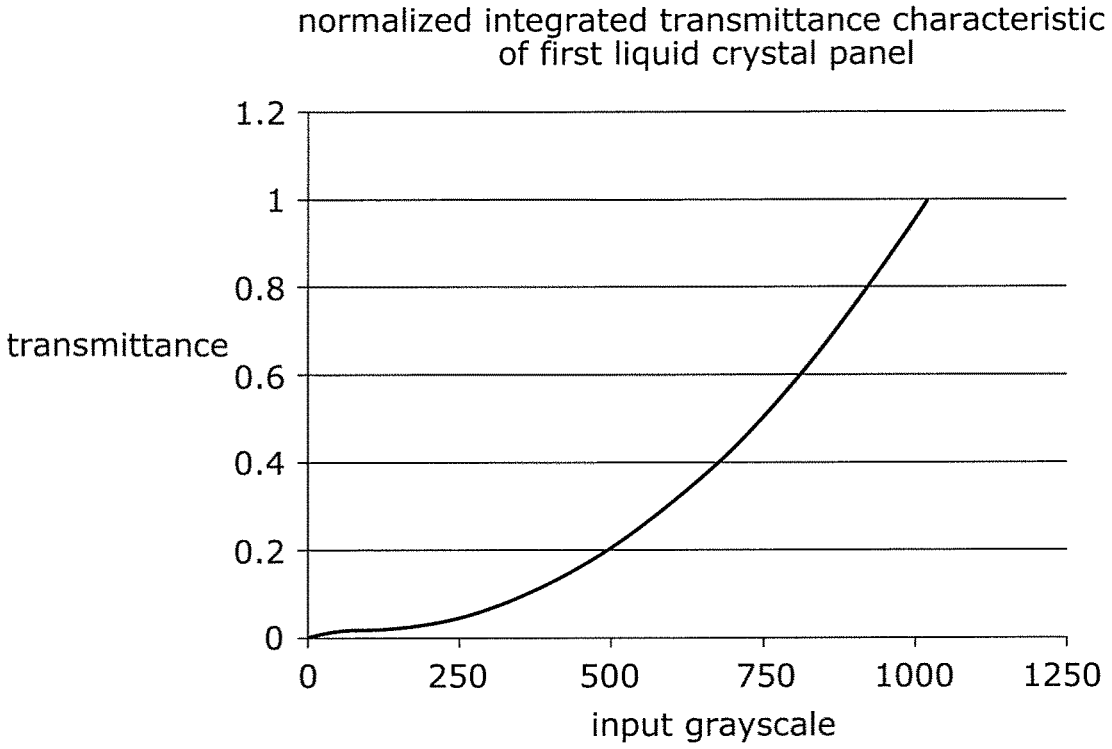
FIG. 20B is a view illustrating a relationship between the input gradation and the transmittance of the first liquid crystal panel of the comparative example.

FIG. 20B is a view illustrating a relationship between the input gradation of the comparative example and the transmittance of first liquid crystal panel 1020 (in the example of FIG. 20B, the normalized integrated transmittance).

Although the above processing reduces the degradation of the image quality due to the parallax, sometimes the prevention of the degradation of the image quality due to the further parallax is required depending on specifications.

For this reason, it is considered that the generation of the parallax itself is prevented by for example making the interval between first liquid crystal panel 1020 and second liquid crystal panel 1030 small. For example, the parallax reduction unit 1093 can be eliminated by making the interval between first liquid crystal panel 1020 and second liquid crystal panel 1030 small to such an extent that the degradation of the image quality (for example, the generation of the double image) due to the parallax is not noticeable.

However, when the thickness of the adhesive layer (for example, OCA (Optical Clear Adhesive)) for bonding first liquid crystal panel 1020 and second liquid crystal panel 1030 is reduced, the adhesive layer cannot absorb stress acting between first liquid crystal panel 1020 and second liquid crystal panel 1030, and a cell gap (the thickness of the liquid crystal layer) of at least one of first liquid crystal panel 1020 and second liquid crystal panel 1030 becomes uneven by the stress. As a result, the display unevenness (for example, luminance unevenness or color unevenness) caused by the cell gap is generated in liquid crystal display device 1010, and the image quality is degraded.

The inventors of the present disclosure have intensively studied a liquid crystal display device that can prevent the degradation of the image quality due to the display unevenness caused by for example making the interval between first liquid crystal panel 1020 and second liquid crystal panel 1030 small while preventing the degradation of the image quality due to the parallax by making the interval small. The inventors have found that the above problem can be solved by correcting the display unevenness generated in at least one of first liquid crystal panel 1020 and second liquid crystal panel 1030 through signal processing. Specifically, the inventors have found that the display unevenness can be accurately prevented by performing the signal processing on the image signals distributed by a distributor.

Hereinafter, exemplary embodiments will be described with reference to the drawings. The following exemplary embodiments provide comprehensive or specific examples of the present disclosure. Numerical values, shapes, materials, components, disposition positions of the components, connection modes of the components, steps, and order of the steps that are illustrated in the following exemplary embodiments are examples, and therefore are not intended to limit the present disclosure. Among the components in the following exemplary embodiments, the components that are not recited in the independent claims indicating the broadest concept are described as an optional component.

The drawings are schematic diagrams, and not necessarily strictly illustrated. In the drawings, substantially the same configuration is designated by the same reference numerals, and overlapping description will be omitted or simplified.

First Exemplary Embodiment

A liquid crystal display device according to a first exemplary embodiment will be described below with reference to FIGS. 1 to 9.

[1-1. Configuration of Liquid Crystal Display Device]

Figure 1:
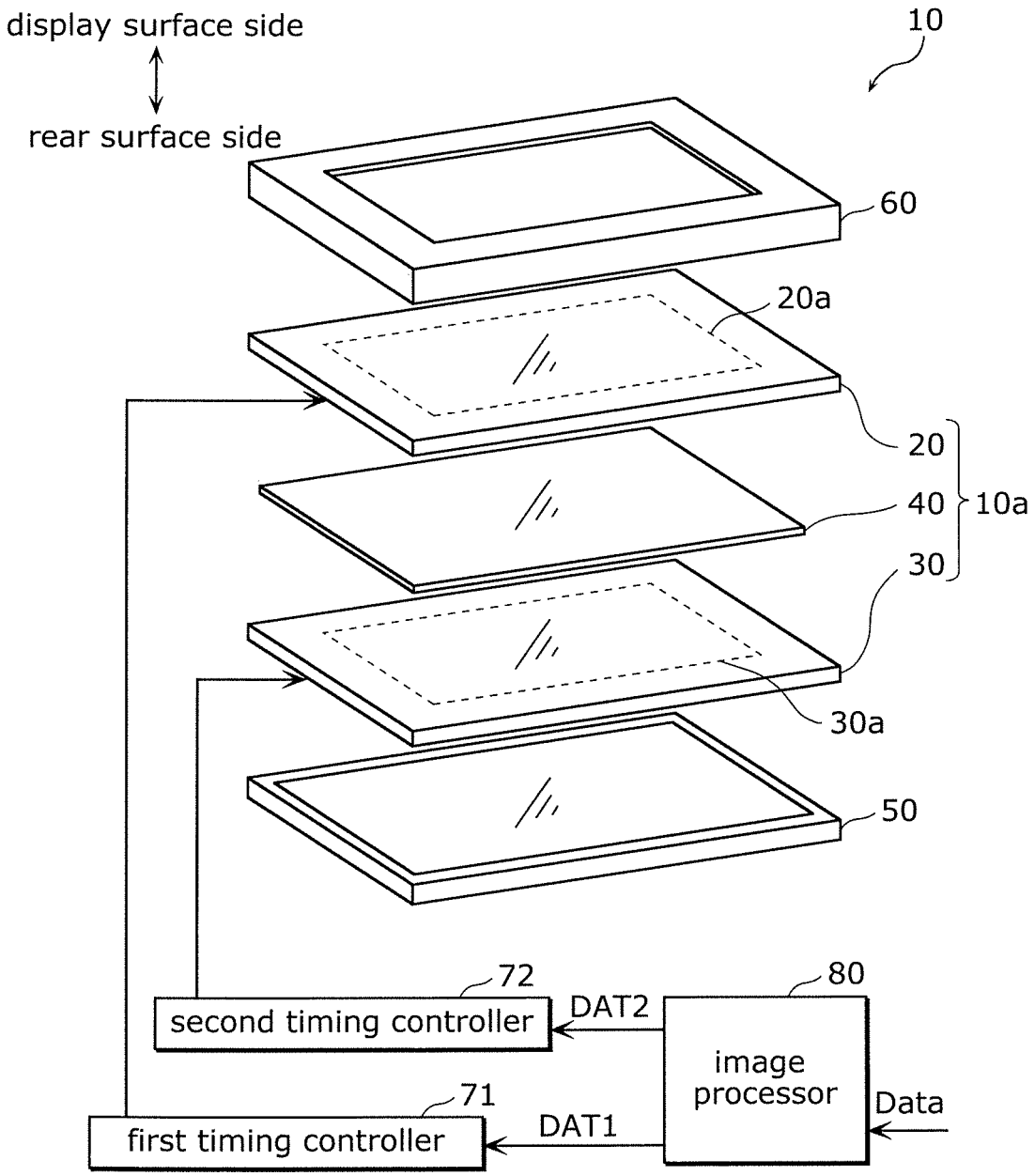
FIG. 1 is an exploded perspective view illustrating a liquid crystal display device according to a first exemplary embodiment.
Figure 2:
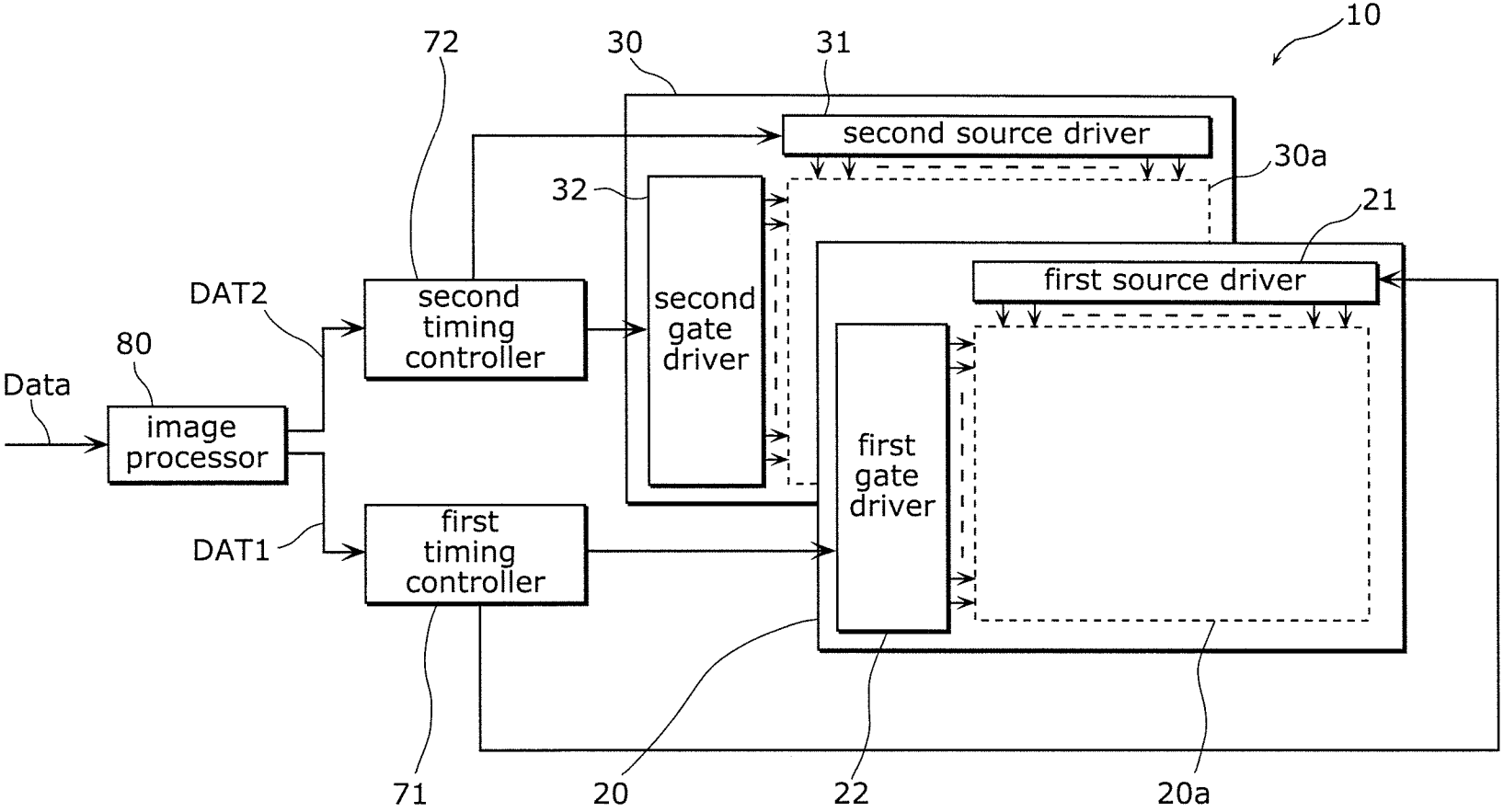
FIG. 2 is a view illustrating a schematic configuration of the liquid crystal display device of the first exemplary embodiment.

A schematic configuration of whole liquid crystal display device 10 of the first exemplary embodiment will be described with reference to FIGS. 1 to 5. FIG. 1 is an exploded perspective view illustrating liquid crystal display device 10 of the first exemplary embodiment. FIG. 2 is a view illustrating the schematic configuration of liquid crystal display device 10 of the first exemplary embodiment. FIG. 2 illustrates the configuration of a driver of first liquid crystal panel 20 and second liquid crystal panel 30 in liquid crystal display device 10.

As illustrated in FIG. 1, liquid crystal display device 10 includes first liquid crystal panel 20 disposed at a position (front side) closer to the observer, second liquid crystal panel 30 disposed at a position (rear side) farther from the observer than first liquid crystal panel 20 is, adhesive layer 40 for bonding first liquid crystal panel 20 and second liquid crystal panel 30, backlight 50 disposed on a rear surface side (rear side) of second liquid crystal panel 30, and front chassis 60 covering first liquid crystal panel 20 and second liquid crystal panel 30 from an observer side.

First liquid crystal panel 20 and second liquid crystal panel 30 bonded together by the adhesive layer 40 constitute liquid crystal display unit 10*a* (liquid crystal module), and are fixed to a middle frame (not illustrated) and a rear frame (not illustrated) together with backlight 50. Liquid crystal display unit 10*a* is an example of the display unit including first liquid crystal panel 20 and second liquid crystal panel 30 that are disposed while superimposed on first liquid crystal panel 20 on the rear surface side of first liquid crystal panel 20.

First liquid crystal panel 20 is a main panel that displays an image visually recognized by a user. In the first exemplary embodiment, first liquid crystal panel 20 displays a color image. On the other hand, second liquid crystal panel 30 is a sub-panel disposed on the rear surface side of first liquid crystal panel 20. In the first exemplary embodiment, second liquid crystal panel 30 displays a monochrome image (black-and-white image) of an image pattern corresponding to the color image displayed on first liquid crystal panel 20 in synchronization with the color image.

For example, liquid crystal driving systems of first liquid crystal panel 20 and second liquid crystal panel 30 may be a lateral electric field system such as an IPS system or an FFS system. First liquid crystal panel 20 and second liquid crystal panel 30 are a normally black type in which white is displayed during a voltage applied state while black is displayed during a voltage non-applied state.

For example, the thickness of adhesive layer 40 is less than or equal to 0.5 mm. The generation of the parallax can be prevented by setting the thickness of adhesive layer 40 to 0.5 mm or less.

As illustrated in FIG. 2, first source driver 21 and first gate driver 22 are provided in first liquid crystal panel 20 in order to display the color image corresponding to the input image signal on first image display region 20*a*.

On the other hand, second source driver 31 and second gate driver 32 are provided in second liquid crystal panel 30 in order to display the monochrome image corresponding to the input image signal on second image display region 30*a*.

As illustrated in FIG. 1, backlight 50 is a surface light source that emits light toward first liquid crystal panel 20 and second liquid crystal panel 30. For example, backlight 50 is a light emitting diode (LED) backlight in which the LED is used as a light source. However, backlight 50 is not limited to the LED backlight. In the first exemplary embodiment, backlight 50 is a direct under type. Alternatively, backlight 50 may be an edge type. Backlight 50 may include an optical member such as a diffusion plate (diffusion sheet) that diffuses the light emitted from the light source.

Front chassis 60 is a front frame disposed on the observer side (front side). For example, front chassis 60 is a rectangular frame body. Preferably, front chassis 60 may be made of a metallic material, such as a steel sheet and an aluminum sheet, which has high rigidity, and may be made of a resin material.

Liquid crystal display device 10 also includes first timing controller 71 that controls first source driver 21 and first gate driver 22 of first liquid crystal panel 20, second timing controller 72 that controls second source driver 31 and second gate driver 32 of second liquid crystal panel 30, and image processor 80 that outputs the image data to first timing controller 71 and second timing controller 72.

Image processor 80 receives input image signal Data transmitted from an external system (not illustrated), performs predetermined image processing on input image signal Data, outputs first output image signal DAT1 to first timing controller 71, and outputs second output image signal DAT2 to second timing controller 72. Image processor 80 also outputs a control signal (not illustrated) such as a synchronizing signal to first timing controller 71 and second timing controller 72. First output image signal DAT1 is image data used to display the color image, and second output image signal DAT2 is image data used to display the monochrome image.

In liquid crystal display device 10 of the first exemplary embodiment, the image is displayed while two display panels of, first liquid crystal panel 20 and second liquid crystal panel 30 are superimposed on each other, so that black can be tightened. Consequently, the image having a high contrast ratio can be displayed. For example, liquid crystal display device 10 is a high dynamic range (HDR) compatible television, and a local dimming compatible direct-under type LED backlight may be used as backlight 50. In this case, the color image having the higher contrast ratio and higher image quality can be displayed.

In the first exemplary embodiment, first liquid crystal panel 20 displays the color image in first image display region 20*a*, and second liquid crystal panel 30 displays the black-and-white image in second image display region 30*a*. However, the present disclosure is not limited thereto. Alternatively, for example, first liquid crystal panel 20 may display the black-and-white image in first image display region 20*a*, and second liquid crystal panel 30 may display the color image in second image display region 30*a*. For example, both first liquid crystal panel 20 and second liquid crystal panel 30 may display the color image or the black-and-white image.

Figure 3:
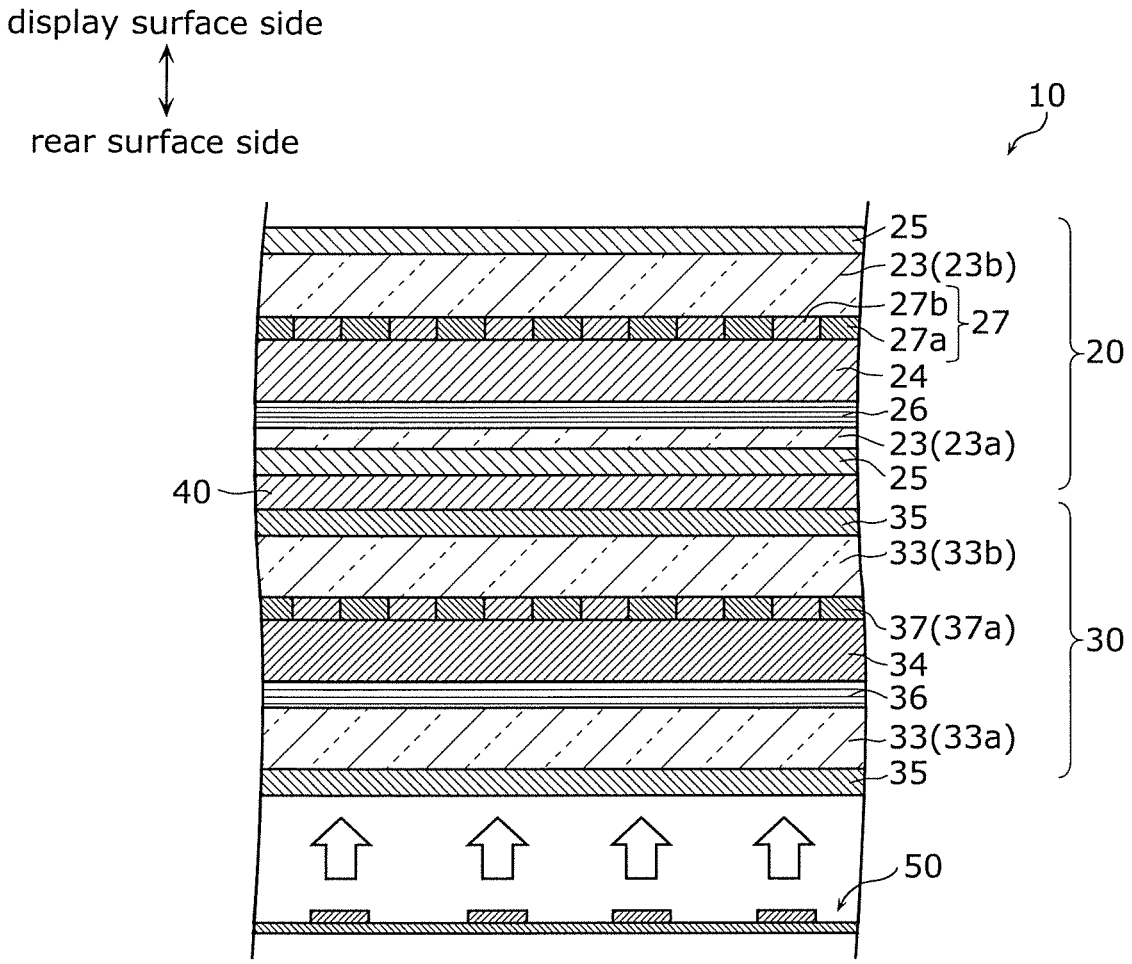
FIG. 3 is a partially enlarged sectional view illustrating the liquid crystal display device of the first exemplary embodiment.

The detailed configuration of liquid crystal display device 10 will be described with reference to FIG. 3. FIG. 3 is an enlarged sectional view illustrating liquid crystal display device 10 of the first exemplary embodiment.

First liquid crystal panel 20 will be described. As illustrated in FIG. 3, first liquid crystal panel 20 includes a pair of first transparent substrates 23, first liquid crystal layer 24, and a pair of first polarizing plates 25.

For example, first transparent substrates 23 are a glass substrate, and are disposed opposite to each other. In the first exemplary embodiment, first transparent substrates 23 located on the second liquid crystal panel 30 side in the pair of first transparent substrates 23 is first TFT substrate 23*a* that is TFT (Thin Film Transistor) substrate on which a TFT and the like are formed, and first transparent substrate 23 located on the side opposite to the second liquid crystal panel 30 side in the pair of first transparent substrates 23 is first counter substrate 23*b*.

First TFT layer 26 on which the TFT or a wiring is provided is formed on a surface of first TFT substrate 23*a* on the first liquid crystal layer 24 side. A pixel electrode used to apply voltage to first liquid crystal layer 24 is formed on a planarization layer of first TFT layer 26. In the first exemplary embodiment, because first liquid crystal panel 20 is driven by the IPS system, not only the pixel electrode but also the counter electrode are formed on first TFT substrate 23*a*. The TFT, the pixel electrode, and the counter electrode are formed in each pixel. An alignment film is formed so as to cover the pixel electrode and the counter electrode.

First counter substrate 23*b* is a color filter substrate (CF substrate) on which color filter 27*b* is formed, and first pixel formation layer 27 including first black matrix 27*a* and color filter 27*b* is formed on the surface of the first counter substrate 23*b* on the first liquid crystal layer 24 side.

First liquid crystal layer 24 is sealed between the pair of first transparent substrates 23. A liquid crystal material for first liquid crystal layer 24 can appropriately be selected according to the driving system. For example, the thickness of first liquid crystal layer 24 ranges from 2.5 μm to 6 μm, but is not limited thereto.

First pixel formation layer 27 is disposed between the pair of first transparent substrates 23. That is, first black matrix 27*a* and color filter 27*b* are disposed between the pair of first transparent substrates 23. A plurality of first openings having a matrix form and constituting pixels are formed in first black matrix 27*a*. That is, each of the plurality of first openings corresponds to each of the plurality of pixels. For example, first black matrix 27*a* is formed into a lattice shape such that each first opening has a rectangular shape in planar view.

Color filter 27*b* is formed in the first opening of first black matrix 27*a*. For example, color filter 27*b* is constructed with a red color filter, a green color filter, and a blue color filter. Each color filter corresponds to each pixel.

A pair of first polarizing plates 25 is a sheet-shaped polarizing film made of a resin material, and is disposed such that the pair of first transparent substrates 23 is sandwiched between the pair of first polarizing plates 25. The pair of first polarizing plates 25 is disposed such that polarization directions of first polarizing plates 25 are orthogonal to each other. That is, the pair of first polarizing plates 25 is disposed in a crossed Nicol state. For example, the thickness of each of the pair of first polarizing plates 25 ranges from 0.05 mm to 0.5 mm, but is not limited thereto.

Second liquid crystal panel 30 will be described below. The second liquid crystal panel 30 includes a pair of second transparent substrates 33, second liquid crystal layer 34, and a pair of second polarizing plates 35.

For example, second transparent substrates 33 are a glass substrate, and disposed opposite to each other. In the first exemplary embodiment, second transparent substrate 33 located on the backlight 50 side in the pair of second transparent substrates 33 is second TFT substrate 33*a*, and second transparent substrate 33 located on the first liquid crystal panel 20 side of the pair of second transparent substrates 33 is second counter substrate 33*b*. Second TFT substrate 33*a* has the same configuration as first TFT substrate 23*a* of first liquid crystal panel 20. Thus, second TFT layer 36 is formed on the surface of the second TFT substrate 33*a* on the second liquid crystal layer 34 side, and the pixel electrode and the counter electrode are formed in each pixel on the planarization layer of second TFT layer 36.

Second pixel formation layer 37 including second black matrix 37*a* is formed on the surface of second counter substrate 33*b* on the second liquid crystal layer 34 side.

Second liquid crystal layer 34 is sealed between the pair of second transparent substrates 33. For example, the thickness of the second liquid crystal layer 34 ranges from 2.5 μm to 6μm, but is not limited thereto.

Second pixel formation layer 37 is disposed between the pair of second transparent substrates 33. That is, second black matrix 37*a* is disposed between the pair of second transparent substrates 33. A plurality of second openings having a matrix form and constituting the pixels are formed in second black matrix 37*a*. That is, each of the plurality of second openings corresponds to each of the plurality of pixels. For example, second black matrix 37*a* is formed into a lattice shape such that each second opening has a rectangular shape in planar view.

A pair of second polarizing plates 35 is a sheet-shaped polarizing film made of a resin material, and is disposed such that the pair of second transparent substrates 33 is sandwiched between the pair of second polarizing plates 35. That is, the pair of second polarizing plates 35 is disposed in the crossed Nicol state. For example, the thickness of each of the pair of second polarizing plates 35 ranges from 0.05 mm to 0.5 mm, but is not limited thereto.

Figure 4:
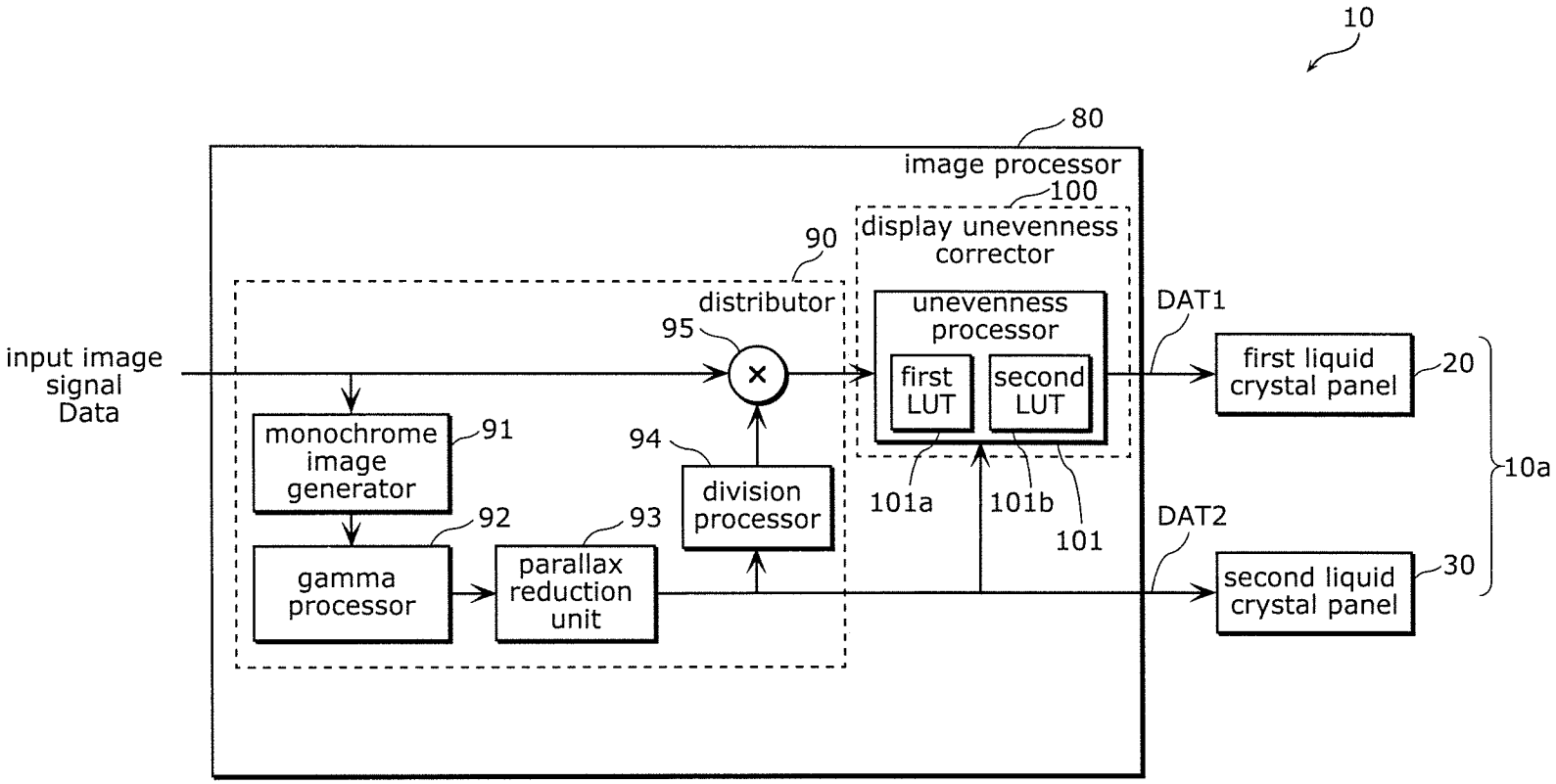
FIG. 4 is a block diagram illustrating a functional configuration of an image processor of the first exemplary embodiment.

The configuration of image processor 80 will be described below with reference to FIGS. 4 and 5. FIG. 4 is a block diagram illustrating a functional configuration of image processor 80 of the first exemplary embodiment.

As illustrated in FIG. 4, image processor 80 is a processor that generates first output image signal DAT1 output to first liquid crystal panel 20 and second output image signal DAT2 output to second liquid crystal panel 30 based on input image signal Data. Image processor 80 includes distributor 90 and display unevenness corrector 100. Image processor 80 of the first exemplary embodiment further includes display unevenness corrector 100 in addition to image processor 1080 of the comparative example. Image processor 80 has features of the gamma characteristic of second liquid crystal panel 30 and the processing in display unevenness corrector 100. In FIG. 4 and the subsequent figures, adhesive layer 40, first timing controller 71, second timing controller 72, and the like are not illustrated for the sake of convenience.

First output image signal DAT1 is input to first liquid crystal panel 20 without performing additional signal processing on first output image signal DAT1. For example, based on first output image signal DAT1 and a display unevenness characteristic of first liquid crystal panel 20, a degree of display unevenness (for example, a difference in transmittance) in the first image can be calculated when first liquid crystal panel 20 displays first output image signal DAT1.

Second output image signal DAT2 is input to the second liquid crystal panel without performing additional signal processing on second output image signal DAT2. For example, based on second output image signal DAT2 and a display unevenness characteristic of second liquid crystal panel 30, a degree of display unevenness (for example, a difference in transmittance) in the second image can be calculated when second liquid crystal panel 30 displays second output image signal DAT2.

The display unevenness of first liquid crystal panel 20 and the display unevenness of second liquid crystal panel 30 are an unevenness that is visually recognized when liquid crystal display unit 10*a* is viewed from the front.

Distributor 90 is a processor that distributes the input image signal into a first distribution image signal used to generate first output image signal DAT1 and a second distribution image signal used to generate second output image signal DAT2. Display unevenness corrector 100 is a processor that performs processing of preventing the display unevenness of liquid crystal display unit 10*a* on the first distribution image signal. First output image signal DAT1 output to first liquid crystal panel 20 is generated when display unevenness corrector 100 performs the processing of preventing the unevenness on the first distribution image signal. In the first exemplary embodiment, distributor 90 outputs the second distribution image signal to second liquid crystal panel 30 as second output image signal DAT2. By way of example, the first distribution image signal is a signal used to generate the color image, and the second distribution image signal is a signal used to display the black-and-white image. However, the present disclosure is not limited to thereto. As used herein, the distribution means the generation of the first distribution image signal and the second distribution image signal based on the input image signal.

Distributor 90 includes black-and-white image generator 91, gamma processor 92, parallax reduction unit 93, division processor 94, and multiplier 95. By way of example, distributor 90 includes parallax reduction unit 93 from the viewpoint of further preventing the degradation of the image quality due to the parallax. However, distributor 90 may not include parallax reduction unit 93. When second liquid crystal panel 30 displays the color image, distributor 90 may not include black-and-white image generator 91. The illustration of the calculator is also omitted.

Black-and-white image generator 91 is the same as black-and-white image generator 1091 of the comparative example, and the description will be omitted. Black-and-white image generator 91 outputs a first black-and-white image data generated based on input image signal Data to gamma processor 92.

Gamma processor 92 differs from gamma processor 1092 of the comparative example in the conversion table (lookup table) used for the processing. Others are similar to those of gamma processor 1092. Gamma processor 92 is an example of the gradation corrector.

The gamma characteristic for second liquid crystal panel 30 will be described with reference to FIG. 5. FIG. 5 is a view illustrating the gamma characteristic of second liquid crystal panel 30 of the first exemplary embodiment. A horizontal axis indicates the gradation value (input gradation) of the black-and-white image. In the input gradation, for example, when input image signal Data is 10 bits, the minimum value is 0 gradation while the maximum value is 1023 gradations. A vertical axis represents the gradation value (output gradation) in the corrected input image signal (the signal output to parallax reduction unit 93). For example, the output gradation is represented by the same bit number as the input gradation. In the first exemplary embodiment, the minimum value is 0 gradation and the maximum value is 1023 gradations.

Figure 5:
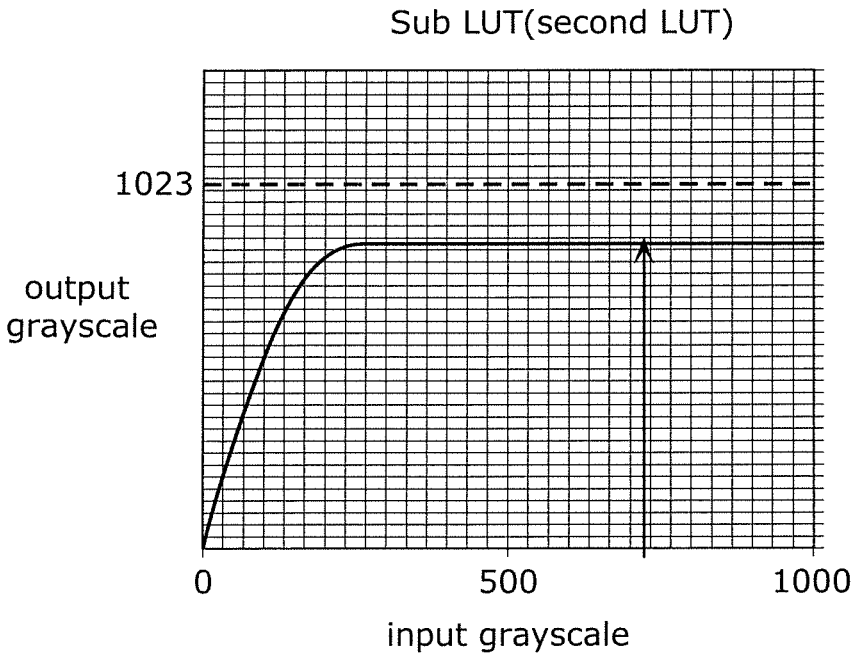
FIG. 5 is a view illustrating a gamma characteristic of a second liquid crystal panel of the first exemplary embodiment.

As illustrated in FIG. 5, similarly to the gamma characteristic of second liquid crystal panel 1030 of the comparative example, the gamma characteristic of second liquid crystal panel 30 has a characteristic in which, in the plurality of gradation values, the input gradation becomes greater than or equal to a predetermined value (for example, 256 gradations, and an example of the first gradation value) while the output gradation becomes a constant value (for example, 850 gradations, and an example of the second gradation value). For example, gamma processor 92 converts the output gradation of the pixel into the same value and outputs the converted value regardless of whether the input gradation of a certain pixel is 512 gradations or 768 gradations. Consequently, when the gradation value is greater than or equal to the predetermined value in the input image signal, the generation of the parallax can be prevented in liquid crystal display unit 10*a*.

At this point, when the input gradation is greater than or equal to the predetermined value, gamma processor 92 may convert the output gradation into a value lower than the maximum value (in the first exemplary embodiment, 1023 gradations) of the output gradation value. In other words, the second gradation value may be smaller than the maximum gradation value that can be output by gamma processor 92. FIG. 5 illustrates an example in which gamma processor 92 evenly converts the output gradation into about 850 gradations when the input gradation is greater than or equal to the predetermined value. In this way, display unevenness corrector 100 (to be described later) can perform the correction to further prevent the display unevenness. As illustrated in FIG. 19A, gamma processor 92 may convert the output gradation into the maximum gradation value of the output gradation when the input gradation is greater than or equal to the predetermined value.

Gamma processor 92 outputs the second black-and-white image data obtained by correcting the first black-and-white image data to parallax reduction unit 93.

Parallax reduction unit 93 is the same as parallax reduction unit 1093 of the comparative example, and the detailed description is omitted. Parallax reduction unit 93 performs the correction on gradation-corrected input image signal Data (specifically, the gradation-corrected first black-and-white image data) output from gamma processor 92 in order to reduce the parallax between the first image based on first output image signal DAT1 and the second image based on second output image signal DAT2. Parallax reduction unit 93 outputs third black-and-white image data generated based on the second black-and-white image data to division processor 94 and second liquid crystal panel 30 as the second distribution image signal. In the first exemplary embodiment, the second distribution image signal and second output image signal DAT2 are identical to each other. That is, it can be reworded that parallax reduction unit 93 outputs second output image signal DAT2 to division processor 94 and second liquid crystal panel 30.

Because division processor 94 and multiplier 95 are the same as division processor 1094 and multiplier 1095 of the comparative example, the description will be omitted.

Display unevenness corrector 100 is a processor that generates first output image signal DAT1 by performing first unevenness correction to prevent the display unevenness based on the display unevenness of liquid crystal display unit 10*a* on the first distribution image signal, and outputs generated first output image signal DAT1 to first liquid crystal panel 20. The display unevenness of liquid crystal display unit 10*a* includes the display unevenness of at least one of first liquid crystal panel 20 and second liquid crystal panel 30. The correction to prevent the display unevenness includes the conversion of the gradation value of each pixel of the first distribution image signal for the purpose of the reduction of the display unevenness. In the example of FIG. 4, display unevenness corrector 100 further performs the first unevenness correction on the first distribution image signal based on second output image signal DAT2. When second liquid crystal panel 30 displays the second image based on second output image signal DAT2, display unevenness corrector 100 acquires second output image signal DAT2 to take into account the display unevenness, which allows the correction of the first distribution image signal.

Display unevenness corrector 100 is an example of the first unevenness corrector that generates first output image signal DAT1 and outputs generated first output image signal DAT1 to first liquid crystal panel 20. In the first exemplary embodiment, display unevenness corrector 100 directly acquires the second distribution image signal from distributor 90. Display unevenness corrector 100 includes unevenness processor 101 that performs the first unevenness correction.

Unevenness processor 101 is a processor that performs processing of correcting the gradation value of each pixel of the first distribution image signal in order to reduce the display unevenness in liquid crystal display unit 10*a*. For example, unevenness processor 101 includes first lookup table 101*a* (also referred to as first LUT 101*a*) used to prevent the display unevenness of first liquid crystal panel 20 and second lookup table 101*b* (also referred to as second LUT 101*b*) used to prevent the display unevenness of second liquid crystal panel 30. Unevenness processor 101 performs the first unevenness correction on the first distribution image signal using first LUT 101*a* and second LUT 101*b*. Unevenness processor 101 performs the first unevenness correction using second output image signal DAT2 (in the first exemplary embodiment, the second distribution image signal) that is acquired from distributor 90 to prevent the display unevenness of second liquid crystal panel 30. The display unevenness can effectively be prevented by acquiring second output image signal DAT2 when second liquid crystal panel 30 displays the image based on second output image signal DAT2.

For example, first LUT 101*a* is a table in which the input gradation and the output gradation are correlated with each pixel of first liquid crystal panel 20 and each gradation value of the pixel. In the first exemplary embodiment, because first liquid crystal panel 20 displays the color image, first LUT 101*a* may include a plurality of tables (for example, three tables) in which the input gradation and the output gradation are correlated with each color value (for example, [R value, G value, B value]) indicating color information.

For example, second LUT 101*b* is a table in which the input gradation and the output gradation are correlated with each pixel of second liquid crystal panel 30 and each gradation value of the pixel. First LUT 101*a* and second LUT 101*b* are created based on at least one of a luminance value and a chromaticity value that are previously obtained by acquiring the display unevenness of the liquid crystal display unit 10*a* in which first liquid crystal panel 20 and second liquid crystal panel 30 are superimposed on each other using an imaging device or the like. The luminance value and the chromaticity value are acquired for each pixel and each gradation value of the pixel. For example, unevenness processor 101 performs the first unevenness correction on each gradation value of each pixel of the first distribution image signal to prevent the display unevenness.

In the display unevenness, sometimes the degree of display unevenness (for example, a difference from original brightness) changes depending on the gradation value. As described above, the display unevenness depending on the gradation value can be prevented by acquiring the luminance value for each gradation value. The acquired luminance value is a value including the display unevenness due to the unevenness of the cell gap (the thickness of at least one of first liquid crystal layer 24 and second liquid crystal layer 34) of at least one of first liquid crystal panel 20 and second liquid crystal panel 30, the cell gap being generated by superimposing first liquid crystal panel 20 and second liquid crystal panel 30 on each other.

For example, unevenness processor 101 refers to first LUT 101*a* to perform processing of converting the gradation value (input gradation) of each pixel of the first distribution image signal into the gradation value (output gradation) used to prevent the display unevenness of first liquid crystal panel 20. The first distribution image signal in which the gradation value is converted using first LUT 101*a* is also referred to as an intermediate image signal.

In the first exemplary embodiment, unevenness processor 101 further performs processing of preventing the display unevenness of second liquid crystal panel 30 on the intermediate image signal based on second output image signal DAT2 and second LUT 101*b*. For example, second LUT 101*b* may be a table in which the input gradation of second output image signal DAT2 is correlated with a correction amount of the gradation value of the intermediate image signal corresponding to the input gradation. Unevenness processor 101 may acquire a correction value used to correct the gradation value of the pixel in each pixel of the intermediate image signal based on second output image signal DAT2 and second LUT 101*b*, and generate second output image signal DAT2 by converting the gradation value of each pixel of the intermediate image signal based on the acquired correction value. As used herein, the correction value is a value used to prevent the display unevenness of second liquid crystal panel 30.

The order of the processing of preventing the display unevenness in unevenness processor 101 is not particularly limited. Unevenness processor 101 may perform the processing of preventing the display unevenness of second liquid crystal panel 30 on the first distribution image signal, and then perform the processing of preventing the display unevenness on first liquid crystal panel 20 on the image signal generated through the processing of preventing the display unevenness of second liquid crystal panel 30.

As described above, unevenness processor 101 can prevent the display unevenness (in this case, at least one of the luminance unevenness and the color unevenness) generated in each of first liquid crystal panel 20 and second liquid crystal panel 30 by converting the gradation value of each pixel of the first distribution image signal using first LUT 101*a*, second LUT 101*b*, and second output image signal DAT2 acquired from distributor 90. In other words, the display unevenness of the composite image formed by first liquid crystal panel 20 and second liquid crystal panel 30 can be prevented by changing only the gradation value of each pixel of the image displayed by first liquid crystal panel 20 in the images displayed by first liquid crystal panel 20 and second liquid crystal panel 30.

Display unevenness corrector 100 may perform the correction to prevent at least one of the display unevenness of first liquid crystal panel 20 and the display unevenness of second liquid crystal panel 30 as the first unevenness correction. For example, display unevenness corrector 100 may refer to at least first LUT 101*a* to convert the gradation value of each pixel of the first distribution image signal, and generate first output image signal DAT1 accordingly. That is, display unevenness corrector 100 may output the intermediate image signal to first liquid crystal panel 20 as first output image signal DAT1. Consequently, the display unevenness can be reduced in at least first liquid crystal panel 20.

[1-2. Processing of Liquid Crystal Display Device]

Figure 6:
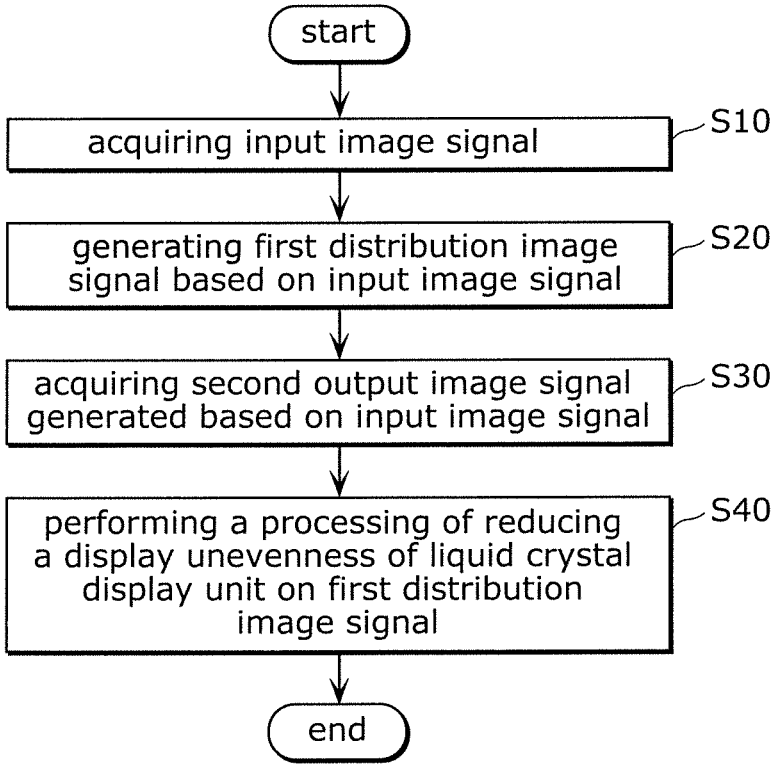
FIG. 6 is a flowchart illustrating operation of the liquid crystal display device of the first exemplary embodiment.
Figure 7:
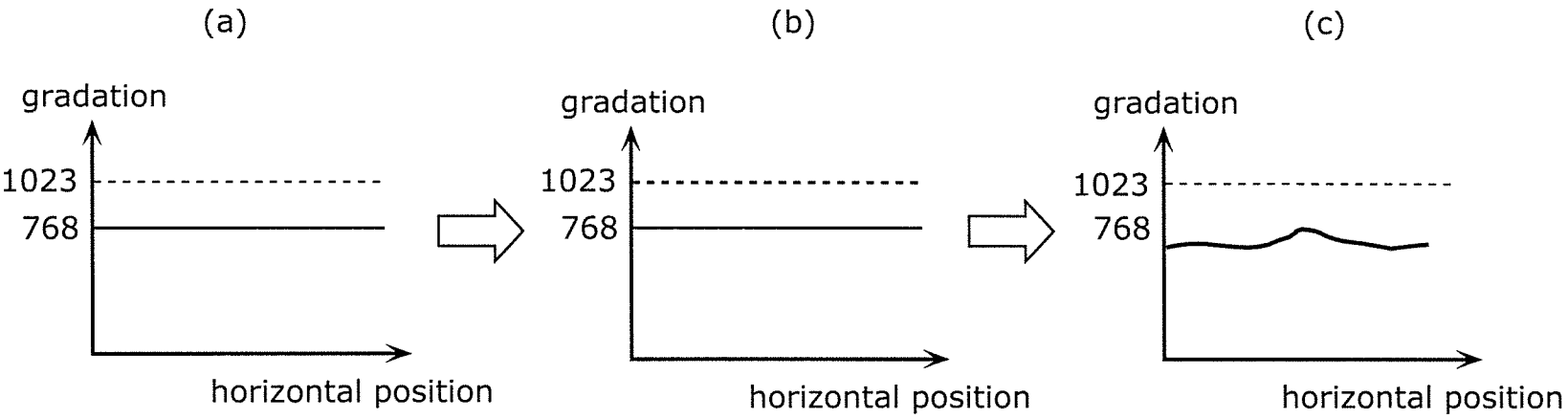
FIG. 7 is a view illustrating generation of a first output image signal of the first exemplary embodiment.

Operation of liquid crystal display device 10 will be described below with reference to FIGS. 6 to 9. FIG. 6 is a flowchart illustrating the operation of liquid crystal display device 10 of the first exemplary embodiment. FIG. 7 is a view illustrating the generation of first output image signal DAT1 of the first exemplary embodiment.

As illustrated in FIG. 6, first, liquid crystal display device 10 acquires input image signal Data (S10). Specifically, image processor 80 acquires input image signal Data by receiving input image signal Data transmitted from an external system (not illustrated). It is assumed that input image signal Data is an image signal used to display the color image.

A part (a) of FIG. 7 is a view illustrating an example of input image signal Data acquired in step S10. A horizontal axis indicates an arrangement direction (for example, the horizontal direction) of the pixels in liquid crystal display unit 10*a* of liquid crystal display device 10, and a vertical axis indicates the gradation value. The part (a) of FIG. 7 illustrates an example in which the same gradation value (for example, 768 gradations) is input in the horizontal direction.

Image processor 80 generates the first distribution image signal based on input image signal Data (S20). Specifically, distributor 90 generates the first distribution image signal based on input image signal Data. Distributor 90 outputs the first distribution image signal to display unevenness corrector 100. In the first exemplary embodiment, distributor 90 outputs the color image data used to display the color image to display unevenness corrector 100 as the first distribution image signal.

A part (b) of FIG. 7 is a view illustrating an example of the first distribution image signal. For example, it is assumed that the first distribution image signal is data in which the gradation values in the pixels are equalized.

Figure 8:
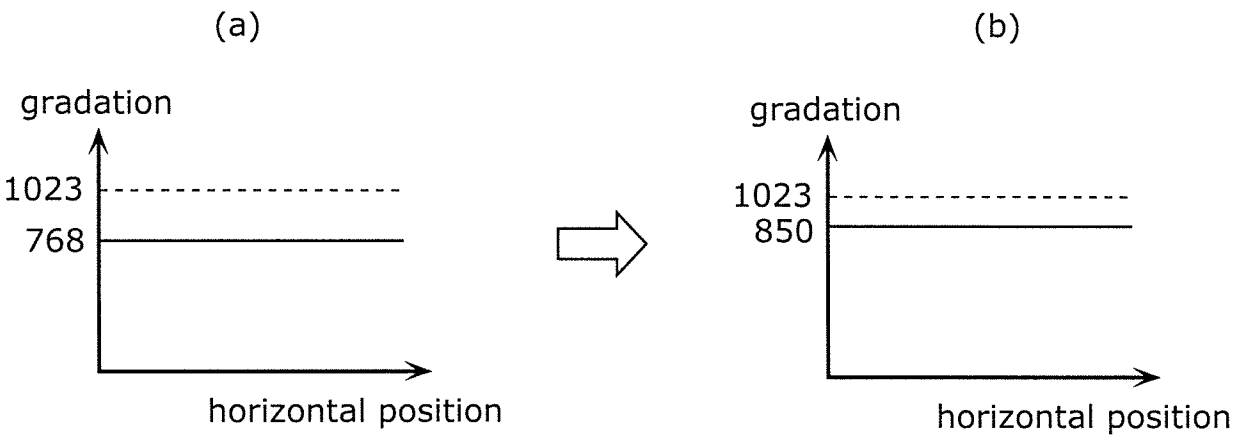
FIG. 8 is a view illustrating generation of a second output image signal of the first exemplary embodiment.
Figure 9:
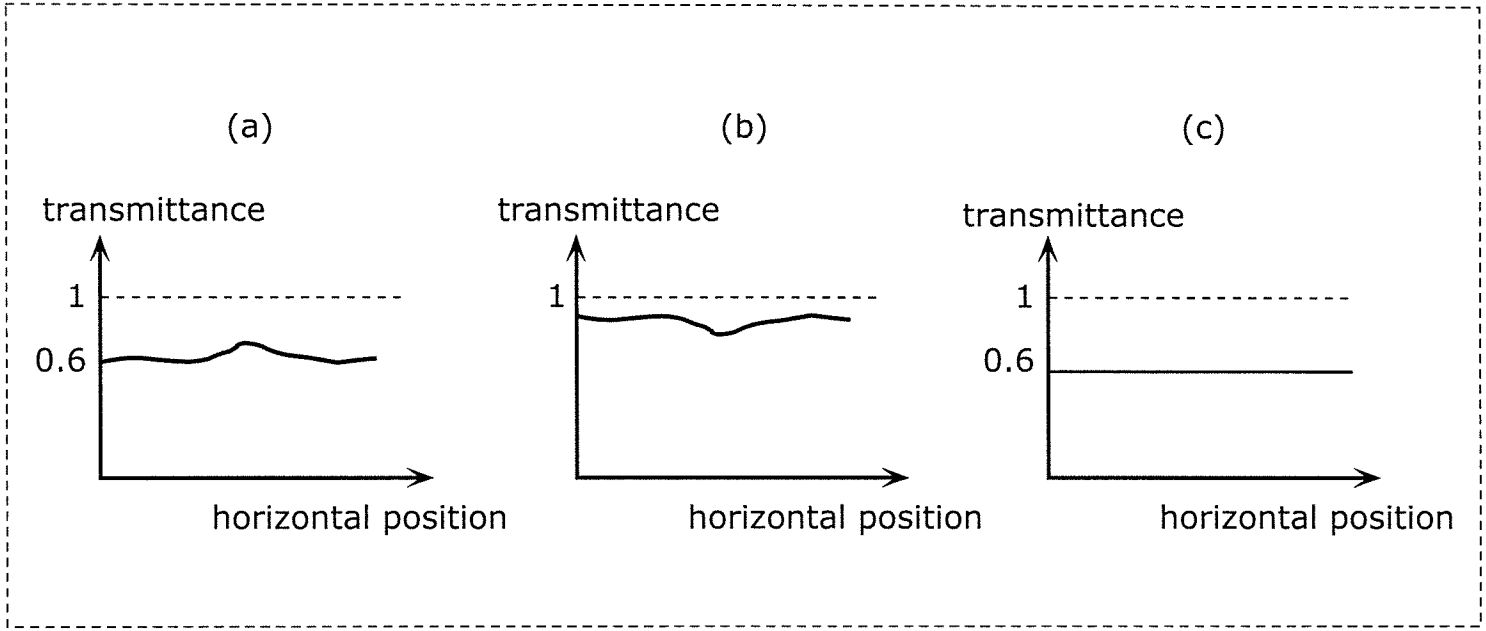
FIG. 9 is a view illustrating transmittance of a liquid crystal display unit of the first exemplary embodiment.

Subsequently, display unevenness corrector 100 acquires second output image signal DAT2 (in the first exemplary embodiment, the second distribution image signal) generated based on input image signal Data (S30). In the first exemplary embodiment, unevenness processor 101 acquires the second distribution image signal from distributor 90. The second distribution image signal will be described with reference to FIGS. 8 and 9. FIG. 8 is a view illustrating the generation of second output image signal DAT2 of the first exemplary embodiment. FIG. 9 is a view illustrating transmittance of liquid crystal display unit 10*a* of the first exemplary embodiment.

A part (a) of FIG. 8 illustrates input image signal Data, which is the same signal as that in the part (a) of FIG. 7.

A part (b) of FIG. 8 illustrates second output image signal DAT2 output from distributor 90 to second liquid crystal panel 30. For convenience, it is assumed that second output image signal DAT2 is data in which the gradation values in the pixels are equalized.

A part (b) of FIG. 9 illustrates the transmittance of second liquid crystal panel 30 when second liquid crystal panel 30 displays the image based on second output image signal DAT2. The vertical axis indicates a ratio when the maximum value of the transmittance of second liquid crystal panel 30 is set to "1".

As illustrated in the part (b) of FIG. 9, the transmittance of second liquid crystal panel 30 varies at each horizontal position of second liquid crystal panel 30 even if the gradation values of the pixels of second output image signal DAT2 are equalized. For example, the transmittance in the substantial center of the horizontal position is lower than that around the center. This is due to the display unevenness (luminance unevenness) caused by the unevenness of the cell gap in second liquid crystal panel 30.

Subsequently, display unevenness corrector 100 performs the processing of reducing the display unevenness of liquid crystal display unit 10*a* on the first distribution image signal (S40). Specifically, unevenness processor 101 converts the gradation value of each pixel of the first distribution image signal based on first LUT 101*a*, second LUT 101*b*, and second output image signal DAT2. Based on second output image signal DAT2 and second LUT 101*b*, display unevenness corrector 100 acquires the correction amount of the gradation value of each pixel in the first distribution image signal used to prevent the display unevenness when second liquid crystal panel 30 displays the image based on second output image signal DAT2.

Unevenness processor 101 corrects the gradation value of each pixel of the first distribution image signal based on the acquired correction amount and first LUT 101*a*. Consequently, first output image signal DAT1 to be output to first liquid crystal panel 20 is generated. Display unevenness corrector 100 outputs generated first output image signal DAT1 to first liquid crystal panel 20.

A part (c) of FIG. 7 illustrates an example of first output image signal DAT1 output to first liquid crystal panel 20. That is, the part (c) of FIG. 7 illustrates an example of the image data after the pixel value of each pixel is converted in order to prevent the display unevenness in liquid crystal display unit 10*a*. As illustrated in the part (c) of FIG. 7, even if the gradation values of the first distribution image signals generated by distributor 90 are equalized, display unevenness corrector 100 corrects the gradation value according to the display unevenness of liquid crystal display unit 10*a*.

A part (a) of FIG. 9 illustrates the transmittance of first liquid crystal panel 20 when first liquid crystal panel 20 displays the image based on first output image signal DAT1. The vertical axis indicates the ratio when the maximum value of the transmittance of first liquid crystal panel 20 is set to "1".

As illustrated in the part (a) of FIG. 9, when the image is displayed based on first output image signal DAT1, the transmittance of first liquid crystal panel 20 varies depending on the horizontal position. For example, the transmittance in the substantial center of the horizontal position is higher than that around the center. This is a result of the processing by display unevenness corrector 100 of making the display unevenness (for example, the display unevenness caused by the unevenness of the cell gap, the display unevenness including at least one of the luminance unevenness and the color unevenness) in first liquid crystal panel 20 and second liquid crystal panel 30 inconspicuous. For example, when a region (hereinafter, also referred to as a bright region) including a pixel or a plurality of pixels brighter than the brightness indicated by second output image signal DAT2 in second liquid crystal panel 30 exists, display unevenness corrector 100 makes the gradation value of the pixel in first liquid crystal panel 20 or the pixel corresponding to the bright region or the pixel included in the region to be darker than the brightness indicated by the first distribution image signal.

Although the details are not illustrated, the transmittance in the part (a) of FIG. 9 is a value in consideration of the display unevenness in first liquid crystal panel 20. In other words, in the composite image of the first image displayed by first liquid crystal panel 20 and the second image displayed by second liquid crystal panel 30, display unevenness corrector 100 corrects the gradation value of the first distribution image signal so as to reduce the display unevenness.

A part (c) of FIG. 9 illustrates the transmittance in liquid crystal display unit 10*a*. Specifically, the part (c) of FIG. 9 illustrates the transmittance in liquid crystal display unit 10*a* when first liquid crystal panel 20 displays the first image based on first output image signal DAT1, and when second liquid crystal panel 30 displays the second image based on second output image signal DAT2. The vertical axis indicates the ratio when the maximum value of the transmittance of liquid crystal display unit 10*a* is set to "1".

As illustrated in the part (c) of FIG. 9, even if the display unevenness is generated in first liquid crystal panel 20 and second liquid crystal panel 30, the display unevenness is reduced by the image processing of display unevenness corrector 100. Liquid crystal display device 10 can reproduce the image expressed by input image signal Data even if the display unevenness is generated in first liquid crystal panel 20 and second liquid crystal panel 30.

[1-3. Effects]

As described above, liquid crystal display device 10 includes liquid crystal display unit 10*a* (an example of the display unit) including first liquid crystal panel 20 and second liquid crystal panel 30 that is disposed while superimposed on first liquid crystal panel 20 on the rear surface side of first liquid crystal panel 20 and image processor 80 that generates first output image signal DAT1 output to first liquid crystal panel 20 and second output image signal DAT2 output to second liquid crystal panel 30 based on input image signal Data. Image processor 80 includes distributor 90 that distributes input image signal Data into the first distribution image signal used to generate first output image signal DAT1 and the second distribution image signal used to generate second output image signal DAT2 and display unevenness corrector 100 (an example of the first unevenness corrector) that generates first output image signal DAT1 by performing the first unevenness correction to prevent the display unevenness of liquid crystal display unit 10*a* with respect to the first distribution image signal output from distributor 90, and outputs generated first output image signal DAT1 to first liquid crystal panel 20.

Consequently, first output image signal DAT1 output to first liquid crystal panel 20 becomes the signal on which the first unevenness correction to prevent the display unevenness in liquid crystal display unit 10*a* is performed. That is, the composite image of the image displayed by first liquid crystal panel 20 based on first output image signal DAT1 and the image displayed by second liquid crystal panel 30 based on second output image signal DAT2 becomes the image in which the display unevenness in liquid crystal display unit 10*a* is prevented. Thus, in liquid crystal display device 10, the degradation of the image quality due to the display unevenness of liquid crystal display unit 10*a* can be prevented only by correcting the signal output to the first liquid crystal panel 20 side. For example, when first liquid crystal panel 20 is a liquid crystal panel that displays the color image, at least one of the luminance unevenness and the color unevenness of liquid crystal display device 10 is prevented by the first unevenness correction.

Liquid crystal display device 10 can prevent the display unevenness of liquid crystal display unit 10*a* without reducing basic performance of the display device such as display accuracy.

Distributor 90 outputs the second distribution image signal to second liquid crystal panel 30 as second output image signal DAT2, and display unevenness corrector 100 performs the first unevenness correction on the first distribution image signal based on second output image signal DAT2.

Consequently, when the display unevenness depending on the gradation value is generated in second liquid crystal panel 30, display unevenness corrector 100 performs the first unevenness correction using second output image signal DAT2 output to second liquid crystal panel 30, whereby the display unevenness of second liquid crystal panel 30 can more accurately be prevented.

Display unevenness corrector 100 also includes first lookup table 101*a* used to prevent the display unevenness of first liquid crystal panel 20 and second lookup table 101*b* used to prevent the display unevenness of second liquid crystal panel 30. Display unevenness corrector 100 performs the first unevenness correction on the first distribution image signal using first lookup table 101*a* and second lookup table 101*b*.

Consequently, when the display unevenness of liquid crystal display unit 10*a* is the display unevenness depending on the gradation value of the image signal, the unevenness correction can more correctly be performed as compared with the case where the unevenness correction is performed by calculation while a processing amount of display unevenness corrector 100 is suppressed. For example, when the lookup table is a table in which the input gradation and the output gradation are correlated with each other in each pixel, at least one of the luminance unevenness and the color unevenness can more finely be corrected.

Distributor 90 includes gamma processor 92 (an example of the gradation corrector) that corrects the gradation value greater than or equal to the first gradation value among the plurality of gradation values included in input image signal Data to the second gradation value and parallax reduction unit 93 that performs correction to reduce the parallax between the first image based on first output image signal DAT1 and the second image based on second output image signal DAT2 with respect to gradation-corrected input image signal Data output from gamma processor 92.

Consequently, liquid crystal display device 10 can display the image in which the parallax is further prevented. For example, when the thickness of adhesive layer 40 is reduced, the parallax is reduced, but not completely eliminated. When liquid crystal display device 10 includes parallax reduction unit 93, the parallax that is reduced but generated can be prevented.

First liquid crystal panel 20 displays the color image, and second liquid crystal panel 30 displays the monochrome image.

Consequently, the display unevenness of liquid crystal display unit 10*a* can be prevented in liquid crystal display device 10 in which first liquid crystal panel 20 displays the color image while second liquid crystal panel 30 displays the monochrome image.

Modification of First Exemplary Embodiment

Figure 10:
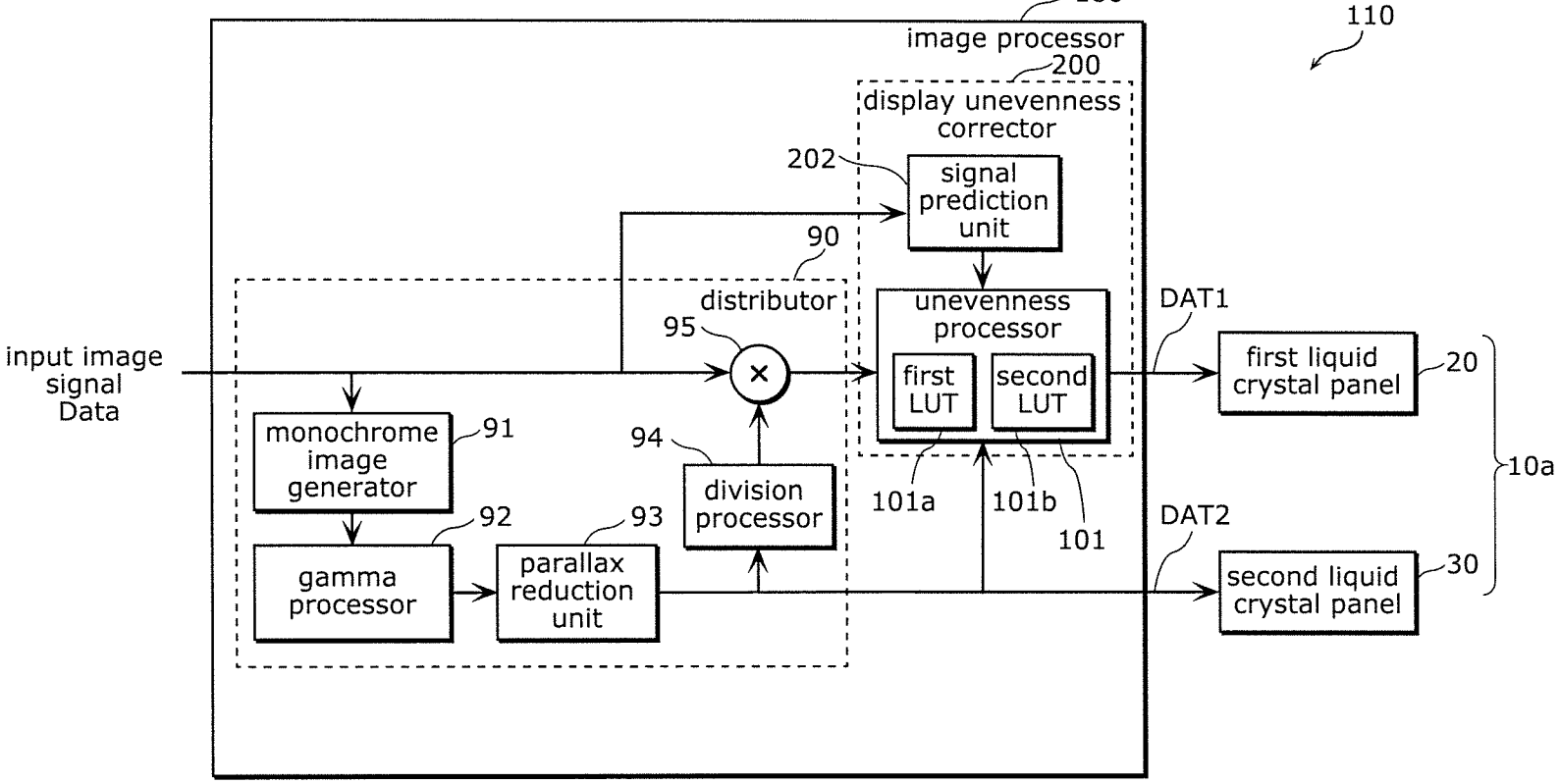
FIG. 10 is a block diagram illustrating a functional configuration of a liquid crystal display device according to a modification of the first exemplary embodiment.

Liquid crystal display device 110 according to a modification will be described below with reference to FIG. 10. FIG. 10 is a block diagram illustrating a functional configuration of liquid crystal display device 110 according to the modification of the first exemplary embodiment; A difference from liquid crystal display device 10 of the first exemplary embodiment will mainly be described, the same configuration is denoted by the same reference numeral, and the description will occasionally be omitted or simplified.

As illustrated in FIG. 10, image processor 180 of liquid crystal display device 110 of the modification includes display unevenness corrector 200 instead of display unevenness corrector 100 included in image processor 80 of liquid crystal display device 10 of the first exemplary embodiment.

Display unevenness corrector 200 does not directly acquire second output image signal DAT2 from distributor 90. Specifically, display unevenness corrector 200 predicts second output image signal DAT2 output to second liquid crystal panel 30 based on input image signal Data, and acquires information equivalent to second output image signal DAT2 accordingly.

In addition to display unevenness corrector 100 of the first exemplary embodiment, display unevenness corrector 200 includes signal prediction unit 202 that predicts second output image signal DAT2 output from distributor 90 to second liquid crystal panel 30 based on input image signal Data. For example, signal prediction unit 202 may predict second output image signal DAT2 based on input image signal Data and the processing of generating second output image signal DAT2 in distributor 90, or predict second output image signal DAT2 by performing predetermined signal processing on input image signal Data. Display unevenness corrector 200 acquires the signal predicted by signal prediction unit 202, and performs the first unevenness correction on the first distribution image signal using the acquired signal.

For example, signal prediction unit 202 is configured to be capable of performing the same processing as the processing of generating second output image signal DAT2 in distributor 90. For example, signal prediction unit 202 may include black-and-white image generator 91, gamma processor 92, and parallax reduction unit 93.

Signal prediction unit 202 outputs second output image signal DAT2 predicted based on input image signal Data to unevenness processor 101. Predicted second output image signal DAT2 may be substantially the same as second output image signal DAT2 that is output to second liquid crystal panel 30 by distributor 90, or second output image signal DAT2 output to second liquid crystal panel 30 and first output image signal DAT1 predicted by signal prediction unit 202 may be different from each other in at least a part of the gradation values.

In step S30 of FIG. 6, display unevenness corrector 100 of the modification acquires second output image signal DAT2 from signal prediction unit 202 of display unevenness corrector 100.

Signal prediction unit 202 is not limited to the prediction of second output image signal DAT2 based on input image signal Data and the processing of generating second output image signal DAT2 in distributor 90. For example, signal prediction unit 202 may predict second output image signal DAT2 based on input image signal Data and the first distribution image signal.

As described above, distributor 90 of liquid crystal display device 110 of the modification outputs the second distribution image signal to second liquid crystal panel 30 as second output image signal DAT2, and display unevenness corrector 200 (an example of the first unevenness corrector) further includes signal prediction unit 202 (an example of the prediction unit) that predicts second output image signal DAT2 based on input image signal Data. The first unevenness correction is performed on the first distribution image signal based on the signal predicted by signal prediction unit 202.

Consequently, when the display unevenness depending on the gradation value is generated in second liquid crystal panel 30, display unevenness corrector 200 can prevent the display unevenness of second liquid crystal panel 30 without acquiring second output image signal DAT2 from distributor 90.

Second Exemplary Embodiment

A liquid crystal display device according to a second exemplary embodiment will be described below with reference to FIGS. 11 to 15.

[2-1. Configuration of Liquid Crystal Display Device]

Figure 11:
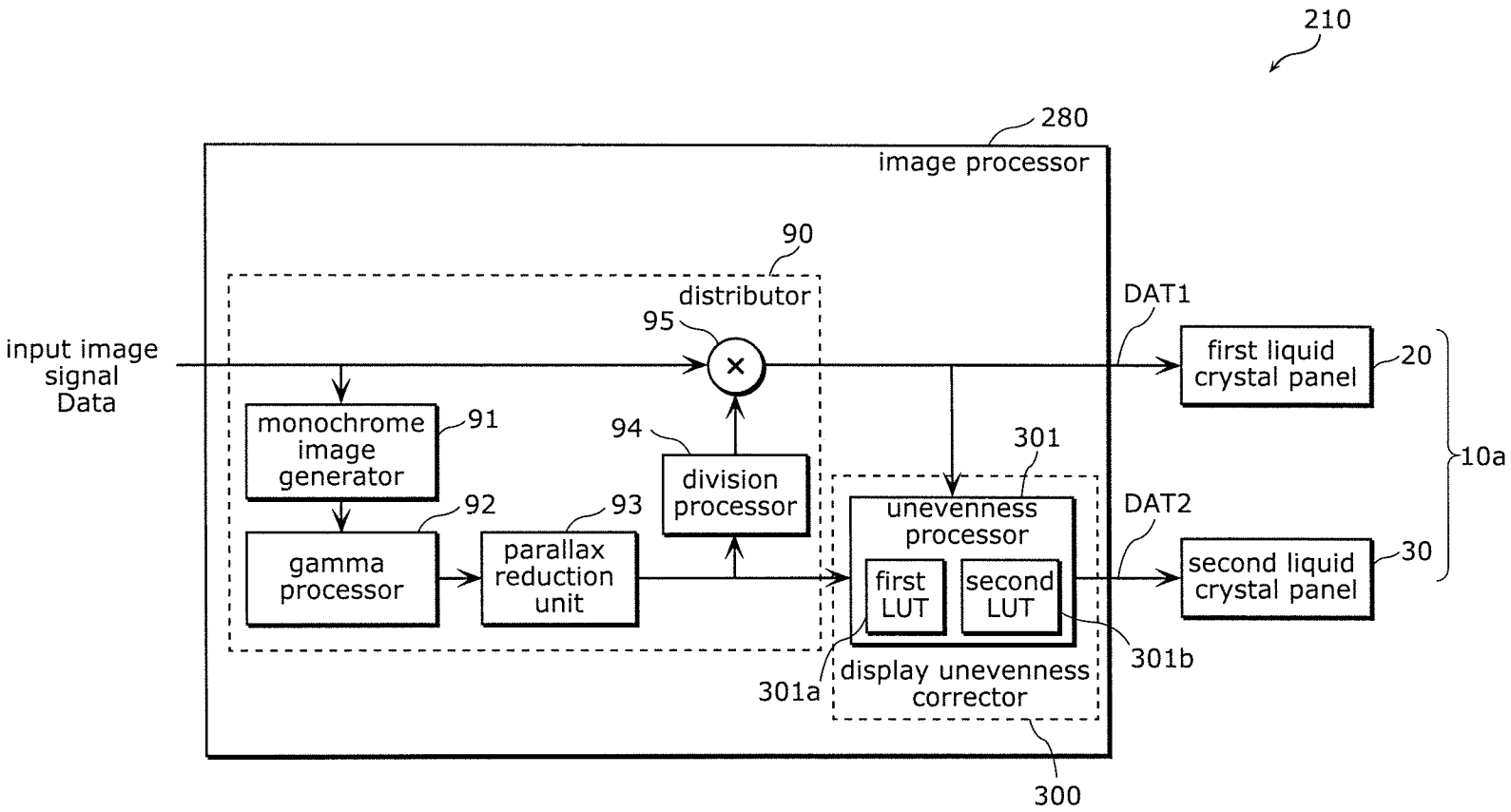
FIG. 11 is a block diagram illustrating a functional configuration of a liquid crystal display device according to a second exemplary embodiment.

A schematic configuration of whole liquid crystal display device 210 of the second exemplary embodiment will be described below with reference to FIG. 11. FIG. 11 is a block diagram illustrating the schematic configuration of liquid crystal display device 210 of the second exemplary embodiment. In the second exemplary embodiment, a difference from liquid crystal display device 10 of the first exemplary embodiment will mainly be described, the same configuration is denoted by the same reference numeral, and the description will occasionally be omitted or simplified.

As illustrated in FIG. 11, image processor 280 of liquid crystal display device 210 of the second exemplary embodiment includes display unevenness corrector 300 instead of display unevenness corrector 100 included in image processor 80 of liquid crystal display device 10 of the first exemplary embodiment. In the second exemplary embodiment, distributor 90 outputs the first distribution image signal to first liquid crystal panel 20 as first output image signal DAT1. The second distribution image signal is an example of the distribution image signal.

As described above, gamma processor 92 of distributor 90 may convert the output gradation into a value smaller than the maximum value (in the second exemplary embodiment, 1023 gradations) of the output gradation when the input gradation is greater than or equal to the predetermined value. In other words, as illustrated in FIG. 5, the second gradation value may be a value smaller than the maximum gradation value that can be output by gamma processor 92.

Display unevenness corrector 300 is a processor that generates second output image signal DAT2 by performing the unevenness correction to prevent the display unevenness of liquid crystal display unit 10*a* on the second distribution image signal, and outputs generated second output image signal DAT2 to second liquid crystal panel 30. The display unevenness of liquid crystal display unit 10*a* includes the display unevenness of at least one of first liquid crystal panel 20 and second liquid crystal panel 30. The correction to prevent the display unevenness includes the conversion of the gradation value of each pixel of the second distribution image signal for the purpose of the reduction of the display unevenness. In the example of FIG. 11, display unevenness corrector 300 further performs the unevenness correction on the second distribution image signal based on first output image signal DAT1. When first liquid crystal panel 20 displays the first image based on first output image signal DAT1, display unevenness corrector 300 acquires first output image signal DAT1 to take into account the display unevenness, which allows the correction of the second distribution image signal.

Display unevenness corrector 300 is an example of the unevenness corrector that generates second output image signal DAT2 and outputs generated second output image signal DAT2 to second liquid crystal panel 30. In the second exemplary embodiment, display unevenness corrector 300 directly acquires the first distribution image signal from distributor 90. Display unevenness corrector 300 includes unevenness processor 301 that performs the unevenness correction.

In the second distribution image signal input to display unevenness corrector 300, because the information about the gradation value greater than or equal to the predetermined value in input image signal Data is lost by the processing in gamma processor 92 (in the example of FIG. 5, the information greater than or equal to 256 gradations), first output image signal DAT1 is hardly predicted based on the second distribution image signal. For this reason, in the second exemplary embodiment, display unevenness corrector 300 acquires the first distribution image signal (that is, first output image signal DAT1) from distributor 90.

Unevenness processor 301 is a processor that performs the processing of correcting the gradation value of each pixel of the second distribution image signal in order to reduce the display unevenness in liquid crystal display unit 10*a*. For example, unevenness processor 301 includes first lookup table 301*a* (also referred to as first LUT 301*a*) used to prevent the display unevenness of first liquid crystal panel 20 and second lookup table 301*b* (also referred to as second LUT 301*b*) used to prevent the display unevenness of second liquid crystal panel 30. Unevenness processor 301 performs the unevenness correction on the second distribution image signal using first LUT 301*a* and second LUT 301*b*. Unevenness processor 301 also performs the unevenness correction using first output image signal DAT1 that is acquired from distributor 90 to prevent the display unevenness of first liquid crystal panel 20. The display unevenness can effectively be prevented by acquiring first output image signal DAT1 when first liquid crystal panel 20 displays the image based on first output image signal DAT1.

For example, unevenness processor 301 refers to second LUT 301*b* to perform the processing of converting the gradation value (input gradation) of each pixel of the second distribution image signal into the gradation value (output gradation) used to prevent the display unevenness of second liquid crystal panel 30. The second distribution image signal in which the gradation value is converted using second LUT 301*b* is also referred to as an intermediate image signal.

In the second exemplary embodiment, unevenness processor 301 performs the processing of preventing the display unevenness of first liquid crystal panel 20 on the intermediate image signal based on first output image signal DAT1 and first LUT 301*a*. For example, first LUT 301*a* may be a table in which the input gradation of first output image signal DAT1 is correlated with a correction amount of the gradation value of the intermediate image signal corresponding to the input gradation. Unevenness processor 301 may acquire a correction value used to correct the gradation value of the pixel in each pixel of the intermediate image signal based on first output image signal DAT1 and first LUT 301*a*, and generate second output image signal DAT2 by converting the gradation value of each pixel of the intermediate image signal based on the acquired correction value. As used herein, the correction value is a value used to prevent the display unevenness of first liquid crystal panel 20.

As illustrated in FIG. 5, the first black-and-white image data is generated with the gradation value (for example, 850 gradations) smaller than the maximum gradation value (for example, 1023 gradations) by a predetermined value as an upper-limit gradation value. For this reason, not only the processing of reducing the gradation value of each pixel but also the processing of increasing the gradation value can be performed in the processing of unevenness processor 301. Thus, in liquid crystal display device 210, the display unevenness of liquid crystal display unit 10*a* can further be reduced as compared with the case where only the processing of reducing the gradation value of each pixel is performed (that is, the case where gamma processor 92 performs the gradation correction using the table in FIG. 19A).

The order of the processing of preventing the display unevenness in unevenness processor 301 is not particularly limited. Unevenness processor 301 may perform the processing of preventing the display unevenness of first liquid crystal panel 20 on the second distribution image signal, and then perform the processing of preventing the display unevenness on second liquid crystal panel 30 on the image signal generated through the processing of preventing the display unevenness of first liquid crystal panel 20.

As described above, unevenness processor 301 can prevent the display unevenness (in this case, the luminance unevenness) generated in each of first liquid crystal panel 20 and second liquid crystal panel 30 by converting the gradation value of each pixel of the second distribution image signal using first LUT 301*a*, second LUT 301*b*, and first output image signal DAT1 acquired from distributor 90. In other words, the display unevenness of the composite image formed by first liquid crystal panel 20 and second liquid crystal panel 30 can be prevented by changing only the gradation value of each pixel constituting the image displayed by second liquid crystal panel 30 in the images displayed by first liquid crystal panel 20 and second liquid crystal panel 30.

Display unevenness corrector 300 may perform the correction to prevent at least one of the display unevenness of first liquid crystal panel 20 and the display unevenness of second liquid crystal panel 30 as the unevenness correction. For example, display unevenness corrector 300 may refer to at least second LUT 301*b* to convert the gradation value of each pixel of the second distribution image signal, and generate second output image signal DAT2 accordingly. That is, display unevenness corrector 300 may output the intermediate image signal to second liquid crystal panel 30 as second output image signal DAT2. Consequently, the display unevenness can be reduced in at least second liquid crystal panel 30.

[2-2. Processing of Liquid Crystal Display Device]

Figure 12:
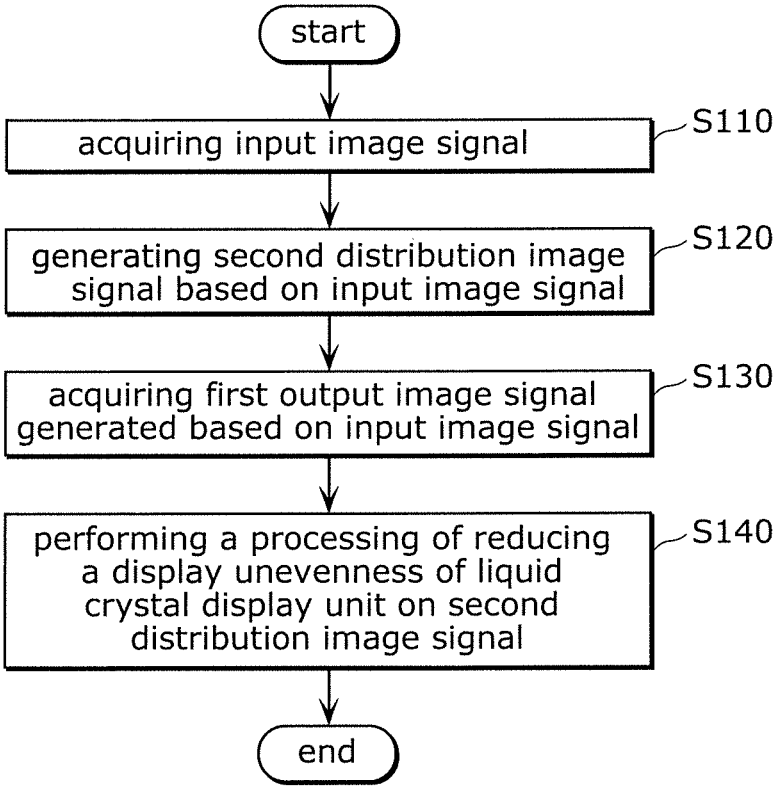
FIG. 12 is a flowchart illustrating operation of the liquid crystal display device of the second exemplary embodiment.
Figure 13:
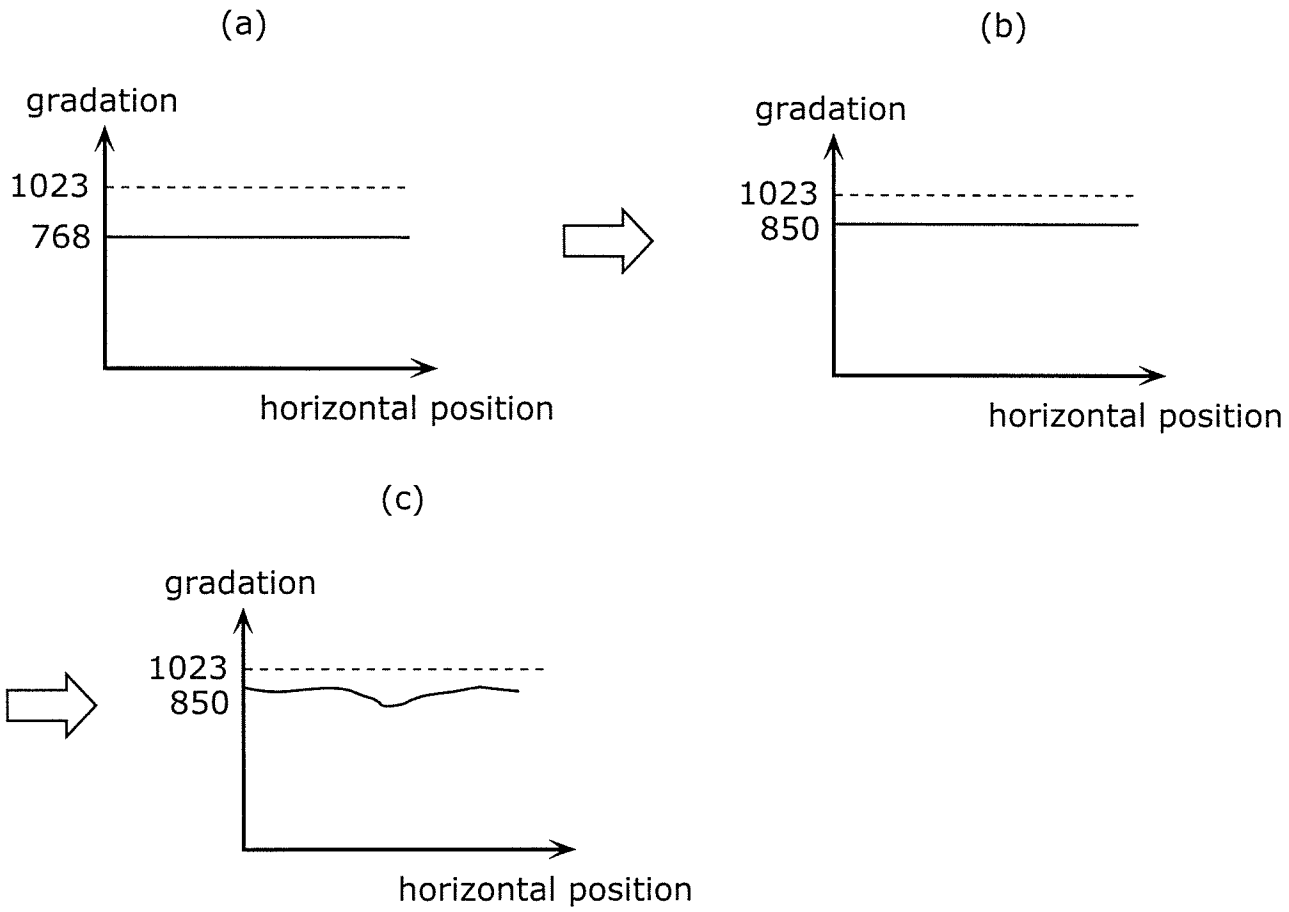
FIG. 13 is a view illustrating generation of a second output image signal of the second exemplary embodiment.

The operation of liquid crystal display device 210 will be described below with reference to FIGS. 12 to 15. FIG. 12 is a flowchart illustrating the operation of liquid crystal display device 210 of the second exemplary embodiment. FIG. 13 is a view illustrating the generation of second output image signal DAT2 of the second exemplary embodiment.

As illustrated in FIG. 12, first, liquid crystal display device 210 acquires input image signal Data (S110). Specifically, image processor 280 acquires input image signal Data by receiving input image signal Data transmitted from an external system (not illustrated).

A part (a) of FIG. 13 is a view illustrating an example of input image signal Data acquired in step S110. The horizontal axis indicates the arrangement direction (for example, the horizontal direction) of the pixels in liquid crystal display unit 10*a* of liquid crystal display device 210, and the vertical axis indicates the gradation value. The part (a) of FIG. 13 illustrates an example in which the same gradation value (for example, 768 gradations) is input in the horizontal direction.

Image processor 280 generates the second distribution image signal based on input image signal Data (S120). Specifically, distributor 90 generates the second distribution image signal based on input image signal Data. Distributor 90 outputs the second distribution image signal to display unevenness corrector 300. In the second exemplary embodiment, distributor 90 outputs the black-and-white image data used to display the black-and-white image to display unevenness corrector 300 as the second distribution image signal. When distributor 90 does not include parallax reduction unit 93, distributor 90 outputs the image data on which gamma processor 92 performs the gradation correction to display unevenness corrector 300 as the second distribution image signal.

A part (b) of FIG. 13 is a view illustrating an example of the second distribution image signal. The second distribution image signal is image data after the gradation value is converted using the gamma characteristic in FIG. 5. For this reason, the constant gradation value (output gradation) is output for the pixel in which the gradation value (input gradation) is greater than or equal to 256 gradations, so that input image signal Data is hardly calculated from the image data in the part (b) of FIG. 13. That is, first output image signal DAT1 is hardly calculated from the image data in the part (b) of FIG. 13.

Figure 14:
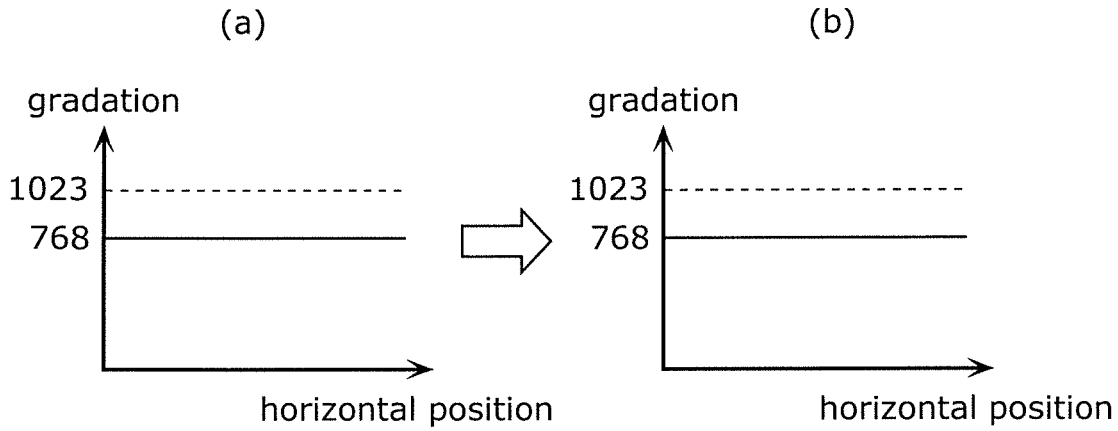
FIG. 14 is a view illustrating generation of a first output image signal of the second exemplary embodiment.
Figure 15:
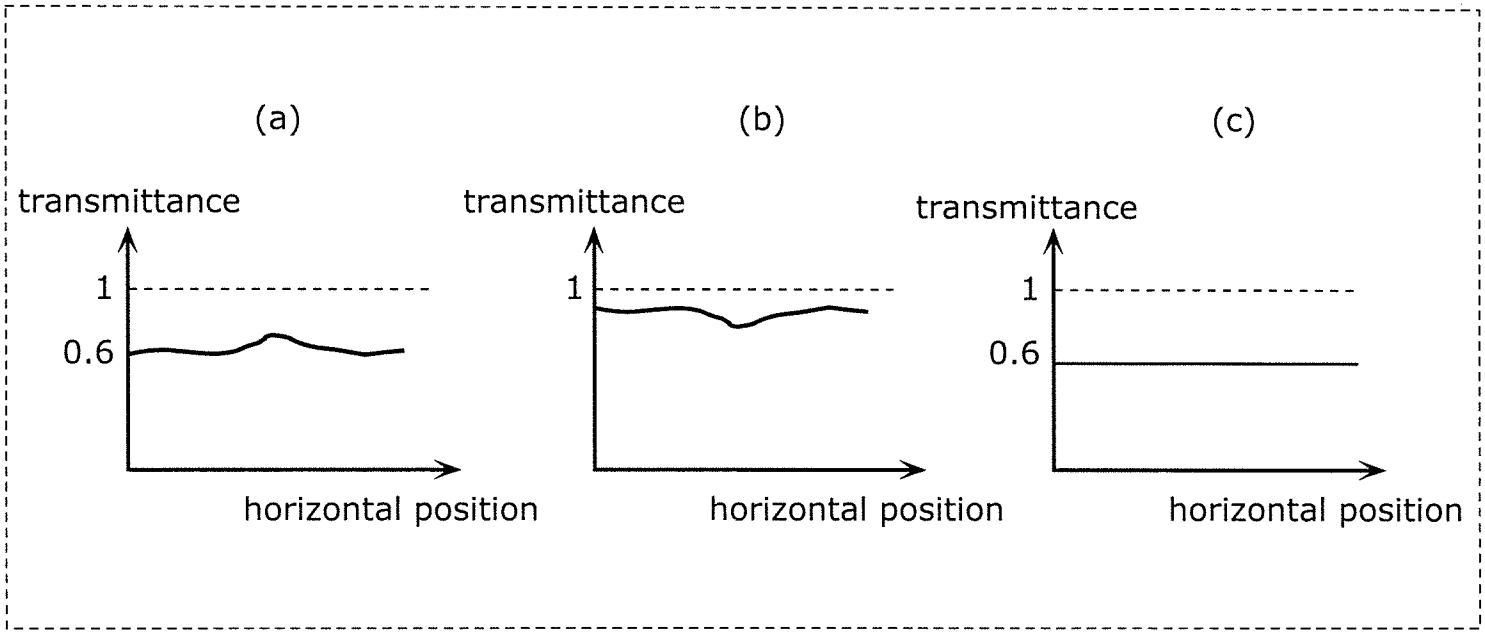
FIG. 15 is a view illustrating transmittance of the liquid crystal display unit of the second exemplary embodiment.

Subsequently, display unevenness corrector 300 acquires first output image signal DAT1 (in the first exemplary embodiment, the first distribution image signal) generated based on input image signal Data (S130). In the second exemplary embodiment, unevenness processor 301 directly acquires first output image signal DAT1 from distributor 90. First output image signal DAT1 will be described with reference to FIGS. 14 and 15. FIG. 14 is a view illustrating the generation of first output image signal DAT1 of the second exemplary embodiment. FIG. 15 is a view illustrating the transmittance of liquid crystal display unit 10*a* of the second exemplary embodiment.

A part (a) of FIG. 14 illustrates input image signal Data, which is the same signal as that in the part (a) of FIG. 13.

A part (b) of FIG. 14 illustrates first output image signal DAT1 output from distributor 90 to first liquid crystal panel 20. For convenience, it is assumed that first output image signal DAT1 is image data in which the gradation values in the pixels are equalized.

A part (a) of FIG. 15 illustrates the transmittance of first liquid crystal panel 20 when first liquid crystal panel 20 displays the image based on first output image signal DAT1. The vertical axis indicates the ratio when the maximum value of the transmittance of first liquid crystal panel 20 is set to "1".

As illustrated in the part (a) of FIG. 15, the transmittance of first liquid crystal panel 20 varies at each horizontal position of first liquid crystal panel 20 even if the gradation values of the pixels of first output image signal DAT1 are equalized. For example, the transmittance in the substantial center of the horizontal position is higher than that around the center. This is due to the display unevenness (luminance unevenness) caused by the unevenness of the cell gap in first liquid crystal panel 20.

Subsequently, display unevenness corrector 300 performs the processing of reducing the display unevenness of liquid crystal display unit 10*a* on the second distribution image signal (S140). Specifically, unevenness processor 301 converts the pixel value of each pixel of the second distribution image signal based on first LUT 301*a*, second LUT 301*b*, and first output image signal DAT1. Based on first output image signal DAT1 and first LUT 301*a*, display unevenness corrector 300 acquires the correction amount of the gradation value of each pixel in the second distribution image signal used to prevent the display unevenness when first liquid crystal panel 20 displays the image based on first output image signal DAT1.

Unevenness processor 301 corrects the gradation value of each pixel of the second distribution image signal based on the acquired correction amount and second LUT 301*b*. Consequently, second output image signal DAT2 to be output to second liquid crystal panel 30 is generated. Display unevenness corrector 300 outputs generated second output image signal DAT2 to second liquid crystal panel 30.

A part (c) of FIG. 13 illustrates an example of second output image signal DAT2 output to second liquid crystal panel 30. That is, the part (c) of FIG. 13 illustrates an example of the image data after the pixel value of each pixel is converted in order to prevent the display unevenness in liquid crystal display unit 10*a*. As illustrated in the part (c) of FIG. 13, even if the gradation values of the second distribution image signals generated by distributor 90 are equalized, display unevenness corrector 300 corrects the gradation value according to the display unevenness of liquid crystal display unit 10*a*.

A part (b) of FIG. 15 illustrates the transmittance of second liquid crystal panel 30 when second liquid crystal panel 30 displays the image based on second output image signal DAT2. The vertical axis indicates a ratio when the maximum value of the transmittance of second liquid crystal panel 30 is set to "1".

As illustrated in the part (b) of FIG. 15, when the image is displayed based on second output image signal DAT2, the transmittance of second liquid crystal panel 30 varies depending on the horizontal position. For example, the transmittance in the substantial center of the horizontal position is lower than that around the center. This is a result of the processing by display unevenness corrector 300 of making the display unevenness (for example, the display unevenness caused by the unevenness of the cell gap, the luminance unevenness) in first liquid crystal panel 20 and second liquid crystal panel 30 inconspicuous. For example, when the region (hereinafter, also referred to as the bright region) including the pixel or the plurality of pixels brighter than the brightness indicated by first output image signal DAT1 in first liquid crystal panel 20 exists, display unevenness corrector 300 makes the gradation value of the pixel in second liquid crystal panel 30 or the pixel corresponding to the bright region or the pixel included in the region to be darker than the brightness indicated by the second distribution image signal.

Although the details are not illustrated, the transmittance in the part (b) of FIG. 15 is a value in consideration of the display unevenness in second liquid crystal panel 30. In other words, in the composite image of the first image displayed by first liquid crystal panel 20 and the second image displayed by second liquid crystal panel 30, display unevenness corrector 300 corrects the gradation value of the second distribution image signal so as to reduce the display unevenness.

A part (c) of FIG. 15 illustrates the transmittance in liquid crystal display unit 10*a*. Specifically, the part (c) of FIG. 15 illustrates the transmittance in liquid crystal display unit 10*a* when first liquid crystal panel 20 displays the first image based on first output image signal DAT1, and when second liquid crystal panel 30 displays the second image based on second output image signal DAT2. The vertical axis indicates the ratio when the maximum value of the transmittance of liquid crystal display unit 10*a* is set to "1".

As illustrated in the part (c) of FIG. 15, even if the display unevenness is generated in first liquid crystal panel 20 and second liquid crystal panel 30, the display unevenness is reduced by the image processing of display unevenness corrector 300. Liquid crystal display device 210 can reproduce the image expressed by input image signal Data even if the display unevenness is generated in first liquid crystal panel 20 and second liquid crystal panel 30.

[2-3. Effects]

As described above, liquid crystal display device 210 includes liquid crystal display unit 10*a* (an example of the display unit) including first liquid crystal panel 20 and second liquid crystal panel 30 that is disposed while superimposed on first liquid crystal panel 20 on the rear surface side of first liquid crystal panel 20 and image processor 280 that generates first output image signal DAT1 output to first liquid crystal panel 20 and second output image signal DAT2 output to second liquid crystal panel 30 based on input image signal Data. Image processor 280 includes distributor 90 that distributes input image signal Data into first output image signal DAT1 and the second distribution image signal (an example of the distribution image signal) used to generate second output image signal DAT2 and display unevenness corrector 300 (an example of the unevenness corrector) that generates second output image signal DAT2 by performing the unevenness correction to prevent the display unevenness of liquid crystal display unit 10*a* on the second distribution image signal output from distributor 90, and outputs generated second output image signal DAT2 to second liquid crystal panel 30.

Consequently, second output image signal DAT2 output to second liquid crystal panel 30 becomes the signal on which the unevenness correction to prevent the display unevenness in liquid crystal display unit 10*a* is performed. That is, the composite image of the image displayed by first liquid crystal panel 20 based on first output image signal DAT1 and the image displayed by second liquid crystal panel 30 based on second output image signal DAT2 becomes the image in which the display unevenness in liquid crystal display unit 10*a* is prevented. Thus, in liquid crystal display device 210, the degradation of the image quality due to the display unevenness of liquid crystal display unit 10*a* can be prevented only by correcting the signal output to the second liquid crystal panel 30 side. For example, when second liquid crystal panel 30 is a liquid crystal panel that displays the black-and-white image, the luminance unevenness of liquid crystal display device 210 is prevented by the unevenness correction.

Liquid crystal display device 210 can prevent the display unevenness of liquid crystal display unit 10*a* without reducing basic performance of the display device such as display accuracy.

Distributor 90 outputs the second distribution image signal to first liquid crystal panel 20 as first output image signal DAT1, and display unevenness corrector 300 further performs the unevenness correction on the second distribution image signal based on first output image signal DAT1.

Consequently, when the display unevenness depending on the gradation value is generated in first liquid crystal panel 20, the display unevenness of first liquid crystal panel 20 can more accurately be prevented by performing the unevenness correction using first output image signal DAT1 output to first liquid crystal panel 20.

Display unevenness corrector 300 also includes first lookup table 301*a* used to prevent the display unevenness of first liquid crystal panel 20 and second lookup table 301*b* used to prevent the display unevenness of second liquid crystal panel 30. Display unevenness corrector 300 performs the unevenness correction on the second distribution image signal using first lookup table 301*a* and second lookup table 301*b*.

Consequently, when the display unevenness of liquid crystal display unit 10*a* is the display unevenness depending on the gradation value of the image signal, the unevenness correction can more correctly be performed as compared with the case where the unevenness correction is performed by calculation while a processing amount of display unevenness corrector 300 is suppressed. For example, when the lookup table is a table in which the input gradation and the output gradation are correlated with each other in each pixel, the luminance unevenness can more finely be corrected.

The second gradation value is smaller than the maximum gradation value that can be output by gamma processor 92 (an example of the gradation corrector).

In this way, display unevenness corrector 300 can perform correction to increase the gradation value of the second distribution image signal. Thus, display unevenness corrector 300 can more correctly prevent the display unevenness of liquid crystal display unit 10*a* as compared with the case where only the correction to reduce the gradation value of the second distribution image signal is performed.

Modification of Second Exemplary Embodiment

Figure 16:
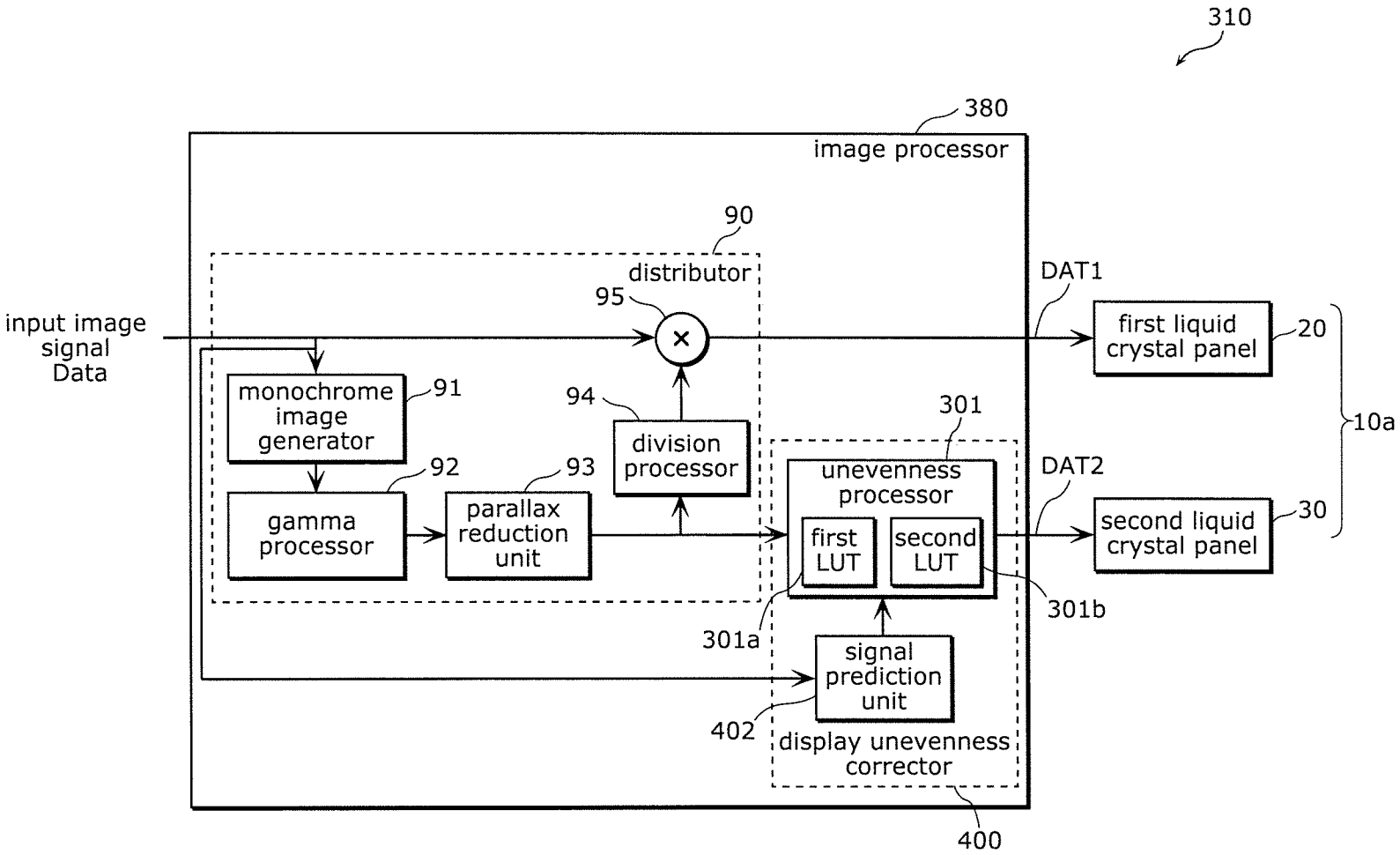
FIG. 16 is a block diagram illustrating a functional configuration of a liquid crystal display device according to a modification of the second exemplary embodiment.

Liquid crystal display device 310 according a modification will be described below with reference to FIG. 16. FIG. 16 is a block diagram illustrating a functional configuration of liquid crystal display device 310 according to the modification of the second exemplary embodiment. A difference from liquid crystal display device 210 of the second exemplary embodiment will mainly be described, the same configuration is denoted by the same reference numeral, and the description will occasionally be omitted or simplified.

As illustrated in FIG. 16, image processor 380 of liquid crystal display device 310 of the modification includes display unevenness corrector 400 instead of display unevenness corrector 300 included in image processor 280 of liquid crystal display device 210 of the second exemplary embodiment.

Display unevenness corrector 400 does not directly acquire first output image signal DAT1 from distributor 90. Specifically, display unevenness corrector 400 predicts first output image signal DAT1 output to first liquid crystal panel 20 based on input image signal Data, and acquires first output image signal DAT1 accordingly.

In addition to display unevenness corrector 300 of the second exemplary embodiment, display unevenness corrector 400 includes signal prediction unit 402 that predicts first output image signal DAT1 output from distributor 90 to first liquid crystal panel 20 based on input image signal Data. For example, signal prediction unit 402 may predict first output image signal DAT1 based on input image signal Data and the processing of generating first output image signal DAT1 in distributor 90, or predict first output image signal DAT1 by performing predetermined signal processing on input image signal Data. Display unevenness corrector 400 performs the unevenness correction on the second distribution image signal using the signal predicted by signal prediction unit 402.

For example, signal prediction unit 402 is configured to be capable of performing the same processing as the processing of generating first output image signal DAT1 in distributor 90. For example, signal prediction unit 402 may include black-and-white image generator 91, gamma processor 92, parallax reduction unit 93, division processor 94, and multiplier 95.

Signal prediction unit 402 outputs first output image signal DAT1 predicted based on input image signal Data to unevenness processor 301. Predicted first output image signal DAT1 may be substantially the same as first output image signal DAT1 that is output to first liquid crystal panel 20 by distributor 90, or first output image signal DAT1 output to first liquid crystal panel 20 and first output image signal DAT1 predicted by signal prediction unit 402 may be different from each other in at least a part of the gradation values.

In step S130 of FIG. 12, display unevenness corrector 400 of the modification acquires first output image signal DAT1 from signal prediction unit 402 of display unevenness corrector 400.

As described above, distributor 90 of liquid crystal display device 310 of the modification outputs the second distribution image signal (an example of the distribution image signal) to first liquid crystal panel 20 as first output image signal DAT1, and display unevenness corrector 400 (an example of the unevenness corrector) further includes signal prediction unit 402 (an example of the prediction unit) that predicts first output image signal DAT1 based on input image signal Data. The unevenness correction is performed on the second distribution image signal based on the signal predicted by signal prediction unit 402.

Consequently, when the display unevenness depending on the gradation value is generated in first liquid crystal panel 20, display unevenness corrector 400 can prevent the display unevenness of first liquid crystal panel 20 without acquiring first output image signal DAT1 from distributor 90.

Third Exemplary Embodiment

A liquid crystal display device according to a third exemplary embodiment will be described below with reference to FIG. 17.

[3-1. Configuration of Liquid Crystal Display Device]

A schematic configuration of whole liquid crystal display device 410 of the third exemplary embodiment will be described below with reference to FIG. 17. FIG. 17 is a block diagram illustrating a functional configuration of liquid crystal display device 410 of the third exemplary embodiment. A difference from liquid crystal display device 10 of the first exemplary embodiment will mainly be described, the same configuration is denoted by the same reference numeral, and the description will occasionally be omitted or simplified.

Figure 17:
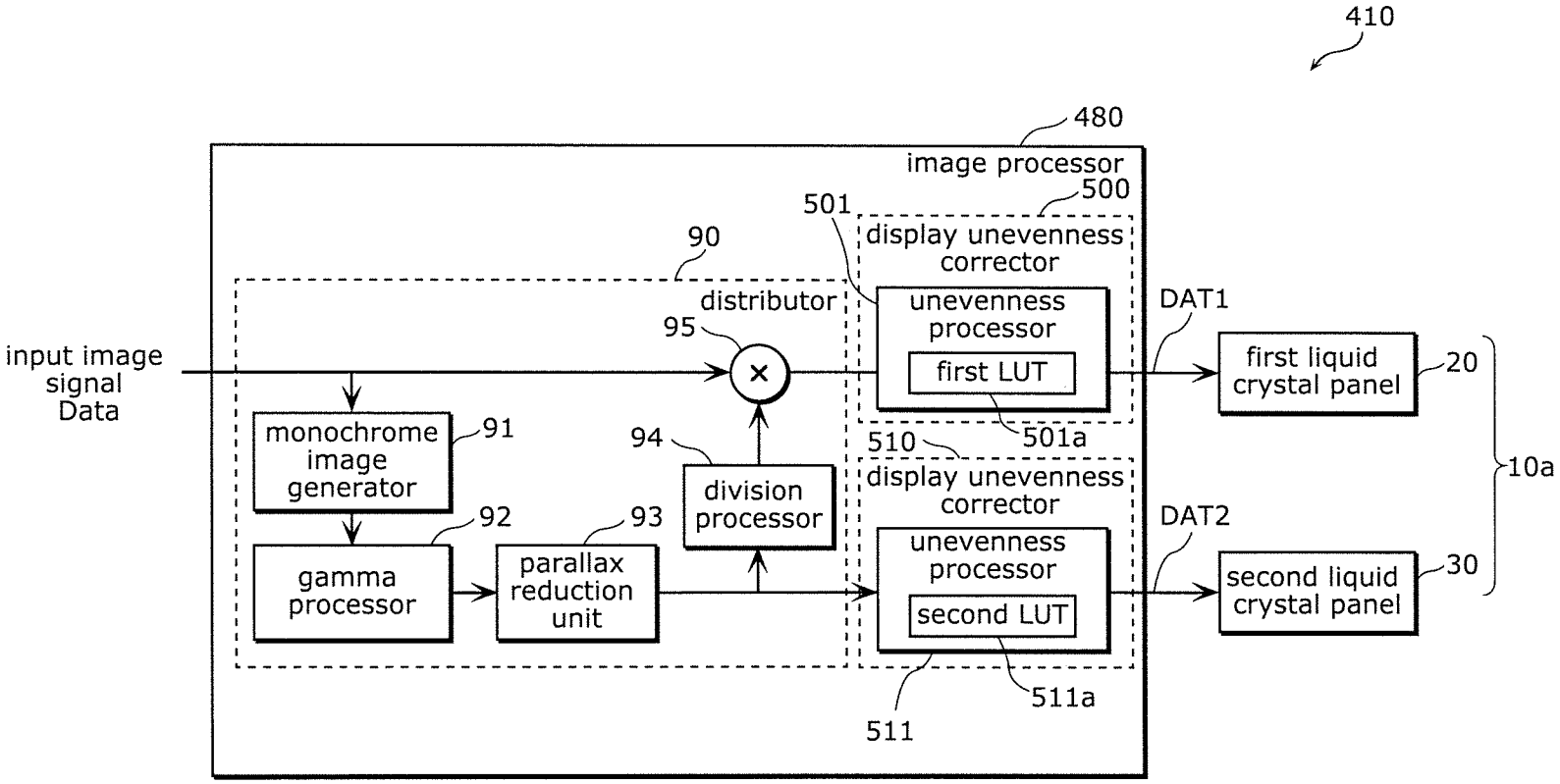
FIG. 17 is a block diagram illustrating a functional configuration of a liquid crystal display device according to a third exemplary embodiment.

As illustrated in FIG. 17, image processor 480 of liquid crystal display device 410 of the third exemplary embodiment includes display unevenness correctors 500 and 510 instead of display unevenness corrector 100 included in image processor 80 of liquid crystal display device 10 of the first exemplary embodiment.

Display unevenness corrector 500 is a processor that generates first output image signal DAT1 by performing the correction to prevent the display unevenness of liquid crystal display unit 10*a* on the first distribution image signal acquired from distributor 90, and outputs generated first output image signal DAT1 to first liquid crystal panel 20. In the third exemplary embodiment, display unevenness corrector 500 includes first lookup table 501*a* (also referred to as first LUT 501*a*) used to prevent the display unevenness of first liquid crystal panel 20, and performs the unevenness correction using first LUT 501*a*. Display unevenness corrector 500 does not acquire the second distribution image signal. That is, display unevenness corrector 500 corrects the gradation value of each pixel of the first distribution image signal based on the display unevenness of first liquid crystal panel 20. Display unevenness corrector 500 is an example of the first unevenness corrector that generates first output image signal DAT1 and outputs generated first output image signal DAT1 to first liquid crystal panel 20. Display unevenness corrector 500 includes unevenness processor 501 that corrects the gradation value.

Unevenness processor 501 is a processor that performs the processing of correcting the gradation value of each pixel of the first distribution image signal in order to reduce the display unevenness in first liquid crystal panel 20. Specifically, unevenness processor 501 corrects the gradation value of each pixel of the first distribution image signal using first LUT 501*a* and the first distribution image signal acquired from distributor 90, and generates first output image signal DAT1 accordingly. The correction of the gradation value of the first distribution image signal by unevenness processor 501 is an example of the first unevenness correction.

Display unevenness corrector 510 is a processor that generates second output image signal DAT2 by performing the unevenness correction to prevent the display unevenness of liquid crystal display unit 10*a* on the second distribution image signal acquired from distributor 90, and outputs generated second output image signal DAT2 to second liquid crystal panel 30. In the third exemplary embodiment, display unevenness corrector 510 includes second lookup table 511*a* (also referred to as second LUT 511*a*) used to prevent the display unevenness of second liquid crystal panel 30, and performs the unevenness correction using second LUT 511*a*. Display unevenness corrector 510 does not acquire the first distribution image signal. That is, display unevenness corrector 510 corrects the gradation value of each pixel of the second distribution image signal based on the display unevenness of second liquid crystal panel 30. Display unevenness corrector 510 is an example of the second unevenness corrector that generates second output image signal DAT2 and outputs generated second output image signal DAT2 to second liquid crystal panel 30. Display unevenness corrector 510 includes unevenness processor 511 that corrects the gradation value.

Unevenness processor 511 is a processor that performs the processing of correcting the gradation value of each pixel of the second distribution image signal in order to reduce the display unevenness in second liquid crystal panel 30. Specifically, unevenness processor 511 corrects the gradation value of each pixel of the second distribution image signal using second LUT 511*a* and the second distribution image signal acquired from distributor 90, and generates second output image signal DAT2 accordingly. The correction of the gradation value of the second distribution image signal by unevenness processor 511 is an example of the second unevenness correction.

For example, when the display unevenness of liquid crystal display unit 10*a* is prevented in one of first liquid crystal panel 20 and second liquid crystal panel 30, the other of first liquid crystal panel 20 and second liquid crystal panel 30 displays the image having the display unevenness. For this reason, the display unevenness is seen when liquid crystal display unit 10*a* is obliquely viewed.

On the other hand, as described above, when the display unevenness of liquid crystal display unit 10*a* is prevented in each of first liquid crystal panel 20 and second liquid crystal panel 30, first liquid crystal panel 20 and second liquid crystal panel 30 each display the image in which the display unevenness is prevented. For this reason, the display unevenness is hardly seen even if liquid crystal display unit 10*a* is obliquely viewed.

Display unevenness corrector 500 prevents the display unevenness of first liquid crystal panel 20 and display unevenness corrector 510 performs the correction to prevent the display unevenness of second liquid crystal panel 30 in the third exemplary embodiment. However, the present disclosure is not limited thereto. Display unevenness corrector 500 may reduce the color unevenness in liquid crystal display unit 10*a*, and display unevenness corrector 510 may perform the correction to reduce the luminance unevenness in liquid crystal display unit 10*a*.

When the polarizing plate (for example, second polarizing plate 35 disposed on the first liquid crystal panel side in FIG. 3) disposed on the first liquid crystal panel side of second liquid crystal panel 30 includes a diffusion layer, the high-frequency display unevenness is hardly prevented only by the second liquid crystal panel 30. For this reason, display unevenness corrector 500 may perform the correction to prevent the high-frequency display unevenness in liquid crystal display unit 10*a*, and display unevenness corrector 510 may perform the correction to prevent the low-frequency display unevenness in liquid crystal display unit 10*a*. That is, the high-frequency display unevenness may be prevented in first liquid crystal panel 20, and the low-frequency display unevenness may be prevented in second liquid crystal panel 30.

For example, when gamma processor 92 performs the gradation correction based on the gamma characteristic in FIG. 19A, display unevenness corrector 510 cannot perform the correction to increase the gradation value. For this reason, when the correction to increase the gradation value is generated in display unevenness corrector 510, display unevenness corrector 500 may perform the correction on the first distribution image signal. Consequently, the display unevenness can be prevented without decreasing the luminance of the image displayed on liquid crystal display unit 10*a*.

[3-2. Effects]

As described above, liquid crystal display device 410 of the third exemplary embodiment further includes display unevenness corrector 510 (an example of the second unevenness corrector) that generates second output image signal DAT2 by performing the second unevenness correction to prevent the display unevenness of liquid crystal display unit 10*a* (an example of the display unit) on the second distribution image signal output from distributor 90, and outputs generated second output image signal DAT2 to second liquid crystal panel 30.

Consequently, as compared with the case where the correction is performed on one of the first distribution image signal and the second distribution image signal, the processing of the display unevenness corrector can be dispersed by correcting both of the first distribution image signal and the second distribution image signal. For example, when first liquid crystal panel 20 displays the color image while second liquid crystal panel 30 displays the black-and-white image, display unevenness corrector 500 performs the processing of correcting the color unevenness on the first distribution image signal, and display unevenness corrector 510 performs the processing of correcting the luminance unevenness on the second distribution image signal, so that the processing amount of each display unevenness corrector can be reduced as compared with the case where both pieces of processing are performed by one display unevenness corrector. Thus, in liquid crystal display device 410, the display unevenness of liquid crystal display unit 10*a* can effectively be prevented.

Display unevenness corrector 500 (an example of the first unevenness corrector) includes first lookup table 501*a* used to prevent the display unevenness of first liquid crystal panel 20, and performs the first unevenness correction using first lookup table 501*a*. Display unevenness corrector 510 includes second lookup table 511*a* used to prevent the display unevenness of second liquid crystal panel 30, and performs the second unevenness correction using second lookup table 511*a*.

Consequently, each of first liquid crystal panel 20 and second liquid crystal panel 30 can display the image in which the display unevenness is prevented. Thus, the display unevenness of liquid crystal display unit 10*a* can be prevented from being seen when liquid crystal display unit 10*a* is obliquely viewed.

Other Exemplary Embodiments

Although the liquid crystal display devices of each embodiment and modification (hereinafter, also referred to as the embodiments and the like) are described above, the present disclosure is not limited to the embodiments.

For example, in the embodiments and the like, the black-and-white image generator may be included in the parallax reduction unit. That is, the input image signal on which the gamma correction is performed by the gamma processor may be input to the black-and-white image generator.

In the embodiments and the like, by way of example, the display unevenness corrector prevents the display unevenness of the liquid crystal display unit generated when the thickness of the adhesive layer is reduced. However, the present disclosure is not limited thereto. The display unevenness corrector may prevent the display unevenness (for example, the display unevenness generated in the liquid crystal panel before the first liquid crystal panel and the second liquid crystal panel are bonded together) generated independently in each of the first liquid crystal panel and the second liquid crystal panel that constitute the liquid crystal display unit.

In the embodiments and the like, by way of example, the first liquid crystal panel and the second liquid crystal panel are bonded together by the adhesive layer such as OCA. However, the present disclosure is not limited thereto. The first liquid crystal panel and the second liquid crystal panel may be fixed using a fixing member capable of fixing the first liquid crystal panel and the second liquid crystal panel at a predetermined interval. Outer peripheral portions of the first liquid crystal panel and the second liquid crystal panel may be fixed by a frame or the like. When the first liquid crystal panel and the second liquid crystal panel are viewed from the front, the adhesive layer (that is, a frame-shaped adhesive layer) may be formed only in the outer region to which the polarizing plate is not bonded. In other words, at least a part of the space between the polarizing plate bonded to the second liquid crystal panel side in the first liquid crystal panel and the polarizing plate bonded to the first liquid crystal panel side in the second panel may be an air layer.

In the embodiments and the like, by way of example, the input gradation and the output gradation are correlated with each other in each pixel in the lookup table. However, the present disclosure is not limited thereto. The lookup table may be a table, in which the image is divided into a plurality of virtual blocks and the input gradation and the output gradation are correlated with each other in each divided virtual block. For example, by setting the plurality of pixels having similar display unevenness modes as one virtual block, the display unevenness can be prevented while the amount of information about the lookup table is decreased.

In the embodiments and the like, by way of example, the display unevenness processor corrects the display unevenness of the liquid crystal display unit using the lookup table. However, the present disclosure is not limited thereto. For example, the display unevenness corrector may perform the unevenness correction by calculating a predetermined constant by the gradation value. For example, it is effective in the case where the display unevenness of the liquid crystal display unit is display unevenness that does not depend on the gradation value of the image signal.

In the embodiments and the like, by way of example, the liquid crystal display device includes two liquid crystal panels. However, the present disclosure is not limited thereto. For example, the liquid crystal display device may include three or more liquid crystal panels.

In the embodiments and the like, the glass substrate is used as the pair of first transparent substrates and the pair of second transparent substrates. However, the present disclosure is not limited thereto, and a transparent resin substrate or the like may be used.

In the embodiments and the like, each component may be constructed with dedicated hardware, or implemented by executing a software program suitable for each component. Each component may be implemented by causing a program execution unit such as a processor to read and execute a software program recorded in a recording medium such as a hard disk and a semiconductor memory. The processor is configured with one or a plurality of electronic circuits including a semiconductor integrated circuit (IC) or a Large Scale Integration (LSI). The plurality of electronic circuits may be integrated in one chip, or provided in a plurality of chips. A plurality of chips may be integrated in one device, or provided in a plurality of devices.

The order of the plurality of pieces of processing described in the embodiments and the like is an example. The order of the plurality of pieces of processing may be changed, or the plurality of pieces of processing may be performed in parallel.

What is claimed is:

1. A liquid crystal display device comprising:

a display unit including a first liquid crystal panel and a second liquid crystal panel that is superimposed on the first liquid crystal panel on a rear surface side of the first liquid crystal panel; and an image processor that generates a first output image signal output to the first liquid crystal panel and a second output image signal output to the second liquid crystal panel based on an input image signal, wherein the image processor includes:

a distributor that distributes the input image signal into a first distribution image signal used to generate the first output image signal and a second distribution image signal used to generate the second output image signal; and a first unevenness corrector that generates the first output image signal by performing first unevenness correction to prevent display unevenness of the display unit on the first distribution image signal output from the distributor, and outputs the generated first output image signal to the first liquid crystal panel, the distributor outputs the second distribution image signal as the second output image signal to the second liquid crystal panel, and the first unevenness corrector includes a prediction unit that predicts the second output image signal based on the input image signal, and the first unevenness corrector performs the first unevenness correction on the first distribution image signal based on the signal predicted by the prediction unit.

2. The liquid crystal display device according to claim 1, wherein the first unevenness corrector includes a first lookup table used to prevent display unevenness of the first liquid crystal panel and a second lookup table used to prevent display unevenness of the second liquid crystal panel, and performs the first unevenness correction on the first distribution image signal using the first lookup table and the second lookup table.

3. The liquid crystal display device according to claim 1, further comprising a second unevenness corrector that generates the second output image signal by performing second unevenness correction to prevent display unevenness of the display unit on the second distribution image signal output from the distributor, and outputs the generated second output image signal to the second liquid crystal panel.

4. The liquid crystal display device according to claim 3, wherein the first unevenness corrector includes a first lookup table used to prevent display unevenness of the first liquid crystal panel, and performs the first unevenness correction using the first lookup table, and the second unevenness corrector includes a second lookup table used to prevent display unevenness of the second liquid crystal panel, and performs the second unevenness correction using the second lookup table.

5. The liquid crystal display device according to claim 1, wherein the distributor includes:

a gradation corrector that corrects gradation values greater than or equal to a first gradation value among a plurality of gradation values included in the input image signal to a second gradation value; and a parallax reduction unit that performs correction on the gradation-corrected input image signal output from the gradation corrector in order to reduce a parallax between a first image based on the first output image signal and a second image based on the second output image signal.

6. The liquid crystal display device according to claim 5, wherein the second gradation value is a value smaller than a maximum gradation value that can be output by the gradation corrector.

7. The liquid crystal display device according to claim 1, wherein the first liquid crystal panel displays a color image, and the second liquid crystal panel displays a monochrome image.

8. A liquid crystal display device comprising:

a display unit including a first liquid crystal panel and a second liquid crystal panel that is superimposed on the first liquid crystal panel on a rear surface side of the first liquid crystal panel; and an image processor that generates a first output image signal output to the first liquid crystal panel and a second output image signal output to the second liquid crystal panel based on an input image signal, wherein the image processor includes:

a distributor that distributes the input image signal into the first output image signal and a distribution image signal used to generate the second output image signal; and an unevenness corrector that generates the second output image signal by performing unevenness correction to prevent display unevenness of the display unit on the distribution image signal output from the distributor, and outputs the generated second output image signal to the second liquid crystal panel, the distributor outputs the distribution image signal as the first output image signal to the first liquid crystal panel, and the unevenness corrector further includes a prediction unit that predicts the first output image signal based on the input image signal, and the unevenness corrector performs the unevenness correction on the distribution image signal based on the signal predicted by the prediction unit.

9. The liquid crystal display device according to claim 8, wherein the unevenness corrector includes a first lookup table used to prevent display unevenness of the first liquid crystal panel and a second lookup table used to prevent display unevenness of the second liquid crystal panel, and performs the unevenness correction on the distribution image signal using the first lookup table and the second lookup table.

10. The liquid crystal display device according to claim 8, wherein the distributor includes:

a gradation corrector that corrects gradation values greater than or equal to a first gradation value among a plurality of gradation values included in the input image signal to a second gradation value; and a parallax reduction unit that performs correction on the gradation-corrected input image signal output from the gradation corrector in order to reduce a parallax between a first image based on the first output image signal and a second image based on the second output image signal.

11. The liquid crystal display device according to claim 10, wherein the second gradation value is a value smaller than a maximum gradation value that can be output by the gradation corrector.

12. The liquid crystal display device according to claim 8, wherein the first liquid crystal panel displays a color image, and the second liquid crystal panel displays a monochrome image.

13. A liquid crystal display device comprising:

a display unit including a first liquid crystal panel and a second liquid crystal panel that is superimposed on the first liquid crystal panel on a rear surface side of the first liquid crystal panel; and an image processor that generates a first output image signal output to the first liquid crystal panel and a second output image signal output to the second liquid crystal panel based on an input image signal, wherein the image processor includes:

a distributor that distributes the input image signal into a first distribution image signal used to generate the first output image signal and a second distribution image signal used to generate the second output image signal; and a first unevenness corrector that generates the first output image signal by performing first unevenness correction to prevent display unevenness of the display unit on the first distribution image signal output from the distributor, and outputs the generated first output image signal to the first liquid crystal panel; and the distributor includes:

a gradation corrector that corrects gradation values greater than or equal to a first gradation value among a plurality of gradation values included in the input image signal to a second gradation value; and a parallax reduction unit that performs correction on the gradation-corrected input image signal output from the gradation corrector in order to reduce a parallax between a first image based on the first output image signal and a second image based on the second output image signal.

14. The liquid crystal display device according to claim 13, wherein the second gradation value is a value smaller than a maximum gradation value that can be output by the gradation corrector.

* * * * *